US010583331B2

(12) United States Patent
Wakibayashi et al.

(10) Patent No.: US 10,583,331 B2
(45) Date of Patent: Mar. 10, 2020

(54) SKIN BODY STRUCTURE FOR BALL

(71) Applicant: MOLTEN CORPORATION, Hiroshima-shi, Hiroshima (JP)

(72) Inventors: Kazuyuki Wakibayashi, Hiroshima (JP); Yosuke Sato, Hiroshima (JP); Naoyuki Fujiwara, Hiroshima (JP); Yukinori Nagao, Hiroshima (JP)

(73) Assignee: Molten Corporation, Hiroshima (JP)

( * ) Notice: Subject to any disclaimer, the term of this patent is extended or adjusted under 35 U.S.C. 154(b) by 0 days.

(21) Appl. No.: 15/104,370

(22) PCT Filed: Dec. 26, 2014

(86) PCT No.: PCT/JP2014/084718
§ 371 (c)(1),
(2) Date: Jun. 14, 2016

(87) PCT Pub. No.: WO2015/099186
PCT Pub. Date: Jul. 2, 2015

(65) Prior Publication Data

US 2016/0310802 A1 Oct. 27, 2016

(30) Foreign Application Priority Data

Dec. 27, 2013 (JP) ..... 2013-271689
Apr. 2, 2014 (JP) ..... 2014-076561

(51) Int. Cl.
*A63B 41/08* (2006.01)
*A63B 43/00* (2006.01)
*A63B 37/14* (2006.01)

(52) U.S. Cl.
CPC ..... *A63B 43/00* (2013.01); *A63B 37/14* (2013.01); *A63B 41/08* (2013.01)

(58) Field of Classification Search
CPC ..... A63B 41/08; A63B 41/085; A63B 43/00; A63B 37/14; A63B 41/10; A63B 45/00; A63B 2209/00
See application file for complete search history.

(56) References Cited

U.S. PATENT DOCUMENTS 79,719 A * 7/1868 Alden ..... 473/602
2,194,674 A * 3/1940 Riddell ..... A63B 41/08 473/597

(Continued)

FOREIGN PATENT DOCUMENTS

BR MU 8400863-6 U 11/2005
CN 102049125 A 5/2011

(Continued)

OTHER PUBLICATIONS

International Search Report dated Mar. 17, 2015, issued in counterpart international Application No. PCT/JP2014/084718, with English translation (8 pages).

(Continued)

*Primary Examiner* — Steven B Wong
(74) *Attorney, Agent, or Firm* — Renner, Otto, Boisselle & Sklar, LLP

(57) ABSTRACT

[Problem] To make a ball easy to be grabbed.
[Solution] In a skin body 3 which covers a ball main body 2, a skin part 2 and a circumferential wall part 3 protruding from a peripheral edge part of the skin part 2 to a back side are integrally formed by molding of injecting a soft material made of resin or rubber into a mold. Alternatively, a structure is such that a step part or flat surface part where a finger is hung is provided on a front surface of the ball main body 2 or a front surface of the skin body 3 which covers the ball main body 2. Alternatively, a front surface of one of adjacent skin bodies 3 and a front surface of the other thereof configure a step part in a radial direction of a ball 1. With (Continued)

this, even in a ball game where the ball 1 is grabbed with hand such as a handball game, when a person grabs the ball 1, the skin part 4 of the skin body 2 is easily recessed, a finger is hung on the step part, or the flat surface part is touched with a finger to make the person feel that the ball 1 has a small outer diameter. With this, the ball 1 becomes easy to be grabbed, thereby making it easy to throw or catch the ball 1.

19 Claims, 24 Drawing Sheets

(56) References Cited

U.S. PATENT DOCUMENTS 2,280,314 A * 4/1942 Scudder ..... B29C 51/16 156/213
3,506,265 A * 4/1970 Hiroshi ..... A63B 41/00 473/125
4,570,931 A * 2/1986 Martin ..... A63B 39/06 473/596
5,028,053 A * 7/1991 Leopold ..... A63B 43/002 473/473
5,048,829 A * 9/1991 Prokupek ..... A63B 43/002 473/595
5,306,001 A * 4/1994 Shishido ..... A63B 41/00 473/604
5,997,422 A * 12/1999 Cooper ..... A63B 41/08 473/599
6,302,815 B1 * 10/2001 Shishido ..... A63B 41/08 473/598
6,348,018 B1 * 2/2002 Ou ..... A63B 41/08 473/143
6,422,961 B1 * 7/2002 Feeney ..... A63B 41/08 473/596
6,443,863 B1 * 9/2002 Dinoffer ..... A63B 43/002 473/595
6,503,162 B1 * 1/2003 Shishido ..... A63B 41/08 473/599
6,726,583 B1 * 4/2004 Lai ..... A63B 41/10 473/599
D520,579 S * 5/2006 Trowers ..... D21/713
7,250,014 B2 * 7/2007 Trowers ..... A63B 43/002 473/595
8,579,741 B2 * 11/2013 Heland ..... A63B 43/002 473/595
D706,883 S * 6/2014 Hedeen, Jr. ..... D21/707
2002/0086749 A1 * 7/2002 Ou ..... A63B 41/00 473/604
2004/0144477 A1 * 7/2004 Taniguchi ..... A63B 41/08 156/147
2006/0046880 A1 * 3/2006 Tang ..... A63B 41/08 473/604
2006/0149081 A1 7/2006 Dubuffet et al.
2007/0117662 A1 * 5/2007 Ma ..... A63B 41/00 473/604
2008/0287230 A1 * 11/2008 Guenther ..... A63B 41/08 473/596
2009/0325747 A1 * 12/2009 Ou ..... A63B 41/08 473/605
2010/0144470 A1 6/2010 Lin
2011/0098135 A1 4/2011 Ono
2012/0052994 A1 * 3/2012 Su ..... A63B 41/08 473/605
2012/0071281 A1 * 3/2012 Heland ..... A63B 43/002 473/569
2012/0088614 A1 * 4/2012 Bulfin ..... A63B 41/08 473/604
2012/0142465 A1 * 6/2012 Berggren ..... A63B 41/08 473/604
2012/0231908 A1 * 9/2012 Fujikura ..... A63B 41/08 473/607
2013/0035182 A1 * 2/2013 Sing ..... A63B 41/08 473/605
2014/0243124 A1 * 8/2014 McNamee ..... A63B 41/08 473/603

FOREIGN PATENT DOCUMENTS

EP 3025767 A1 * 6/2016 ..... A63B 69/0053
JP H05-7271 U 2/1993
JP 2007-209435 A 8/2007
JP 2009-6052 A 1/2009
JP 2009-153541 A 7/2009
JP 2009-153542 A 7/2009
JP 2009-254636 A 11/2009
JP 2011-92713 A 5/2011
WO 2005/097269 A1 10/2005

OTHER PUBLICATIONS

Chinese Office Action corresponding to Chinese Application No. 201480068178.8 dated May 27, 2017.
Extended European Search Report corresponding to European Application No. 14874223.2 dated Aug. 17, 2017.
Japanese Office Action corresponding to Japanese Application No. 2015-555077 dated Nov. 22, 2018 along with English language machine translation.

* cited by examiner

CONVENTIONAL EXAMPLE

Fig.39 CONVENTIONAL EXAMPLE
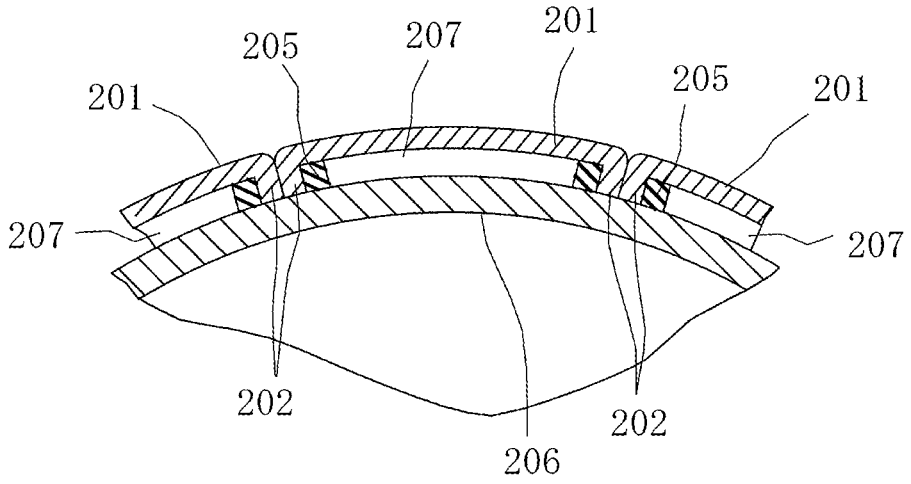
Fig.40 CONVENTIONAL EXAMPLE
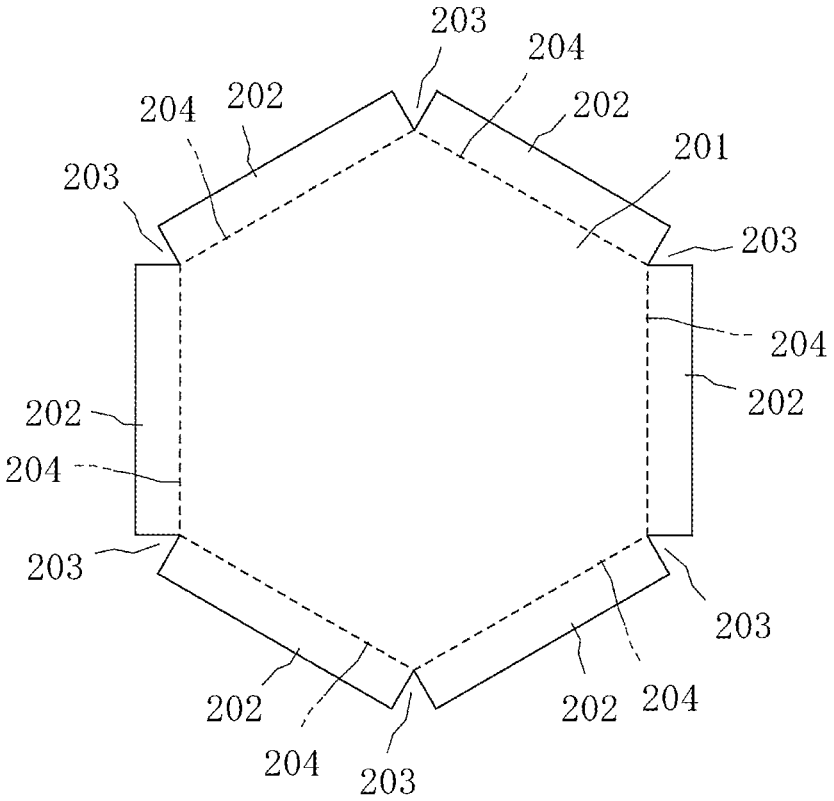

SKIN BODY STRUCTURE FOR BALL

TECHNICAL FIELD

The present invention relates to a ball that is easily grabbed.

BACKGROUND ART

With reference to FIG. 38 to FIG. 40, a skin body 201 disclosed in paragraph 0030 and paragraph 0043 and FIG. 4 of PTL 1 is described. As depicted in FIG. 40, in the skin body 201, notch parts 203 are formed at side edge parts of the skin body 201 to form folding parts 202, and the side edge parts between adjacent notch parts 203 are folded along folding lines 204 indicated by dotted lines to form the folding parts 202. To prevent the folded folding parts 202 from spreading, as depicted in FIG. 38 and FIG. 39, the adjacent folding parts 202 are fixed together with support members 205.

Also, as depicted in FIG. 38 and FIG. 39, when the plurality of skin bodies 201 are attached to a ball main body 206 configured as a sphere, the folding parts 202 of the adjacent skin bodies 201 are bonded together with a bonding agent, the support members 205 are bonded to the ball main body 206 with a bonding agent, and cavity parts 207 are formed between the skin bodies 201 and the ball main body 206.

However, in the skin body 201 disclosed in PTL 1, with the folding parts 202 bonded by a bonding agent to the support members 205 which are members separate from the skin body 201, the folded shapes of the folding parts 202 are kept, thereby making a complex structure.

CITATION LIST

Patent Literature

PTL 1: Japanese Unexamined Patent Application Publication No. 2009-6052

SUMMARY OF INVENTION

Technical Problem

The present invention has been made in view of the background art described above, and has an object of making a ball easy to be grabbed.

Solution to Problem

The present invention is directed to a ball in which a ball main body is covered with a skin body, the skin body including a skin part and a circumferential wall part protruding from a peripheral edge part of the skin part to a ball main body side, and this skin body being integrally formed of a soft material made of resin or rubber, a step part or flat surface part where a finger is hung is provided on a front surface of the ball main body or a front surface of the skin body covering the ball main body, or a flat surface part formed of a flat surface or a curved surface with a large radius of curvature approximating to the flat surface is provided on the front surface of the ball main body or the front surface of the skin body covering the ball main body.

Advantageous Effects of Invention

In the present invention, even in a ball game where a ball is grabbed with hand such as a handball game, when a person grabs the ball, the skin part of the skin body is easily recessed, a finger is hung on a step part, or a flat surface part is touched with a finger to make the person feel that the ball has a small outer diameter. With this, the ball becomes easy to be grabbed, thereby making it easy to throw or catch the ball.

In the present invention, if a beveled part configured by removal so that a dihedral angle between the skin part and the circumferential wall part forms a flat surface or curved surface is provided on a front side of the skin body, when a plurality of skin bodies are affixed to the ball main body to configure a ball, a valley part based on the beveled part is formed on a boundary between adjacent skin bodies, and a hand is held in the valley part, thereby making the ball easy to be grabbed.

In the present invention, if non-slippery asperities or a coating film made of a non-slippery material is formed on the front surface of the skin part, the ball becomes easy to be grabbed.

In the present invention, if a bulging part configured to extend from the circumferential wall part to a center part side and be separated from the skin part is provided on a back side of the skin body or if a bottom part is formed over the circumferential wall part and a cavity part configured to be surrounded by the skin part, the circumferential wall part, and the bottom part is provided inside the skin body, with the bulging part or the bottom part bonded to the ball main body with a bonding agent, a bonding area with respect to the ball main body is increased, and bonding strength is increased.

In the present invention, if a foam region part configured to be surrounded by the skin part and the circumferential wall part is integrally formed inside the skin body, a touch feeling without a bottoming feeling can be obtained when a person grabs a ball. In addition, since the circumferential wall part and the foam region part can be bonded to the ball main body, the bonding area with respect to the ball main body is increased, and bonding strength is increased.

In the present invention, if a plurality of skin bodies are provided and a front surface of one of adjacent ones of the skin bodies and a front surface of another thereof configure a step part in a radial direction of the ball or if a cavity part is provided on a back surface of the skin body and the cavity part is formed as a space surrounded by the ball main body and the skin body when the skin body covers the ball main body, when a person grabs the ball, the skin body is easily recessed to allow the person to easily grab the ball.

In the present invention, if a cushion part is provided to the cavity part of the skin body, a touch feeling is improved. Also, if the cushion part is bonded to the ball main body, the bonding area with respect to the ball main body is increased, and bonding strength is increased.

In the present invention, if the step part is configured of a recessed part, when a person grabs the ball, a finger tip enters the recessed part, thereby allowing a finger pulp to be easily hung around the recessed part.

In the present invention, if an adhesion material is provided to the step part, the position of the adhesion material is not deviated, and a finger is bonded to the adhesion material to be made easily hung on the step part.

In the present invention, if a beveled part configuring a valley part on a boundary between adjacent skin bodies is provided, the ball becomes in a hand-stitch style.

BRIEF DESCRIPTION OF DRAWINGS

FIG. 39 is a sectional view partially depicting a conventional ball having a skin body affixed to a ball main body, as being cut in a diameter direction of the ball.

FIG. 40 is a developed view of a conventional skin body.

DESCRIPTION OF EMBODIMENTS

Figure 1:
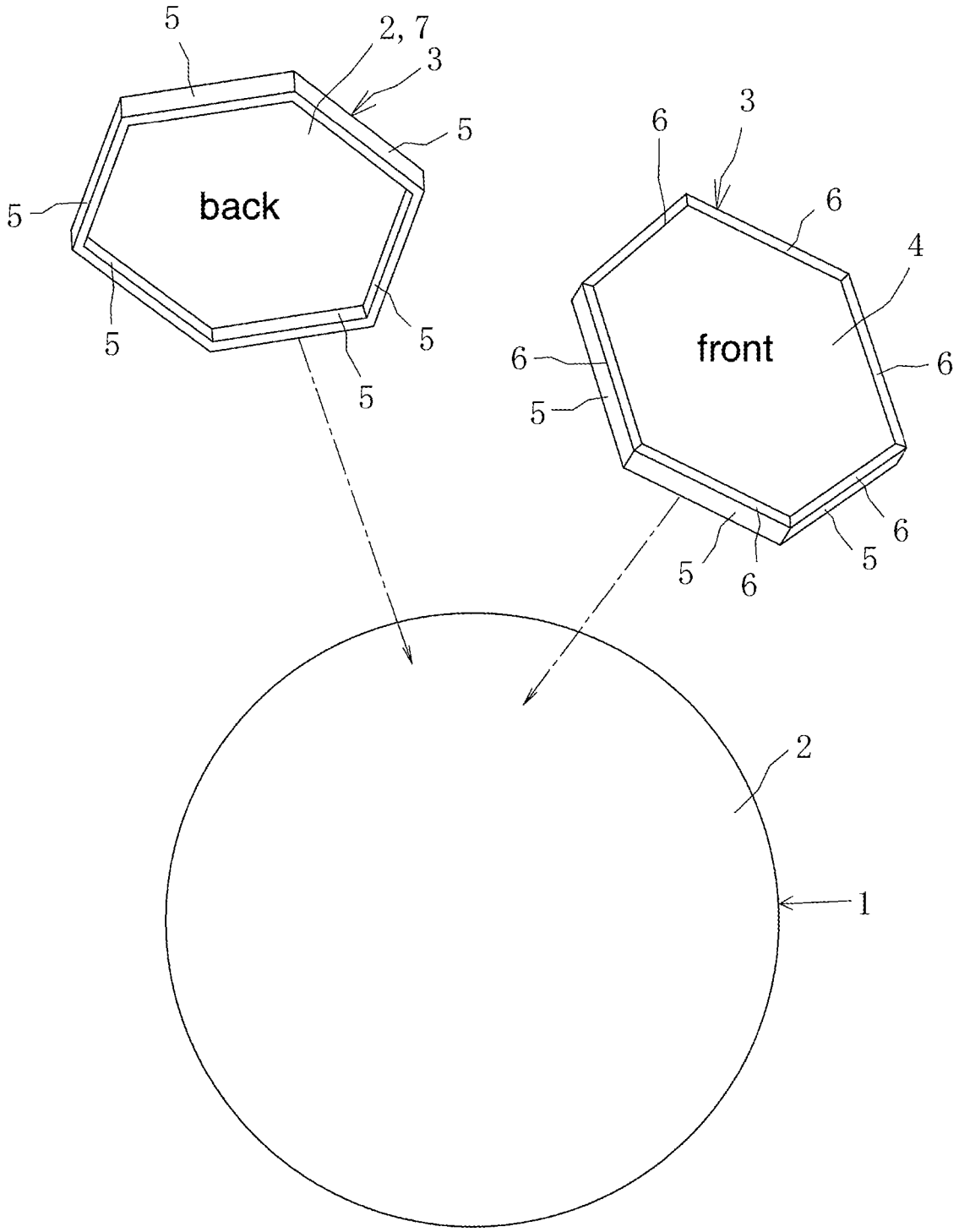
FIG. 1 is a perspective view depicting a ball according to a first embodiment exploded into a ball main body and a skin body.

With reference to FIG. 1, a ball 1 according to a first embodiment is described. In FIG. 1, the ball 1 is configured in a manner such that a plurality of skin bodies 3 are affixed to a ball main body 2 with a bonding agent not depicted. To the ball main body 2, any of the following structures can be applied: a sphere, an ellipsoid, or a shape similar thereto;

other than the sphere, a sphere, ellipsoid, or shape similar thereto provided with a flat surface part, such as a truncated icosahedron; a structure where a string is wound around a front surface of the ball main body 2; a structure where no string is wound around the front surface of the ball main body 2; a hollow structure that can be bulged where air can be blown to and removed from the inside of the ball main body 2; a hollow structure where air cannot be blown to and removed from the inside of the ball main body 2; and a non-hollow structure where the inside of the ball main body 2 is filled with a cushion material.

While the skin body 3 is depicted as a hexagon in FIG. 1, a shape other than a hexagon can also be similarly applied. By molding of injecting a soft material made of resin or rubber into a mold, such as injection molding, press molding, vacuum forming, or blow molding, the skin body 3 is configured to have a skin part 4, a circumferential wall part 5, a beveled part 6, and a cavity part 7 integrally formed, and has a simple structure without using the support members 125 described in paragraph 0004.

The skin part 4 has a dome shape such as a spherical surface protruding from a back side to a front side. Therefore, the skin part 4 configures a three-dimensional curved surface along an outer wall surface of the ball 1 defined in advance. Note in this specification that the back side means a ball main body 2 side and the front side means a side to be touched by a person.

The circumferential wall part 5 protrudes from each peripheral edge part of the skin part 4 to the back side of the skin part 4, and is in an annular shape which surrounds the peripheral edge parts of the skin part 4 once. Therefore, on the back surface of the skin part 4, the cavity part 7 surrounded by the skin part 4 and the circumferential wall part 5 is formed.

The beveled part 6 is configured by removal so that a dihedral angle between the skin part 4 and the circumferential wall part 5 forms a flat surface or curved surface on the front side of the skin body 3. That is, shaping is such that the beveled part 6 configured by removal so that the dihedral angle between the skin part 4 and the circumferential wall part 5 forms a flat surface or curved surface is provided on the front side of the skin body 3. Note that a structure is applicable in which the beveled part 6 extends to a portion where the skin body 3 crosses the back surface.

Note that it is also possible to similarly apply non-slippery asperities such as wrinkles, dimples, or knurls or a coating film made of a non-slippery material provided on the front surface of the skin part 4 of FIG. 1. In a structure provided with a coating film, the structure may be such that a coating film is provided to the front surface of the skin part 4 at the time of molding the skin body 3 or such that a coating film is bonded to the front surface of the skin part 4 of the molded skin body 3.

Figure 2:
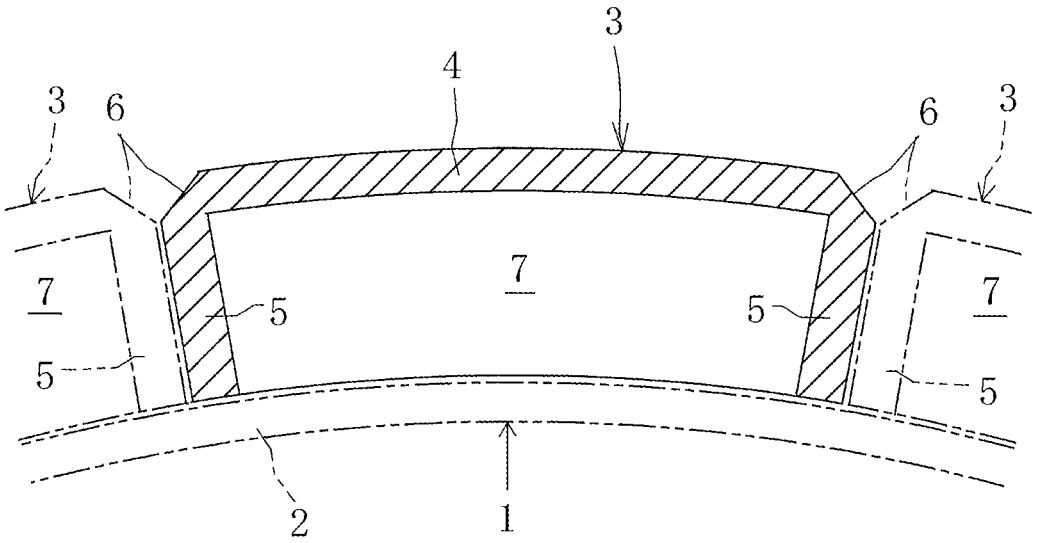
FIG. 2 is a sectional view partially depicting the ball according to the first embodiment having the skin body affixed to the ball main body, as being cut in a diameter direction of the ball.

With reference to FIG. 2, one portion of the ball 1 having the plurality of skin bodies 3 affixed to the ball main body 2 with a bonding agent not depicted according to the first embodiment is described. In FIG. 2, when the plurality of skin bodies 3 are attached to the ball main body 2, the circumferential wall parts 5 of adjacent skin bodies 2 are welded together or bonded with a bonding agent, moisture such as water or sweat is prevented from penetrating from a boundary of the plurality of skin bodies 3 to the ball main body 2 side, and coupling strength among the plurality of skin bodies 3 is improved.

Also, the surfaces of adjacent circumferential wall parts 5 on the ball main body 2 side are welded or bonded with a bonding agent not depicted to the outer wall surface of the ball main body 2, the adjacent skin parts 4 are arranged away from the outer wall surface of the ball main body 2, and the cavity part 7 is formed as a space between the ball main body 2 and the skin body 3 and surrounded by the ball main body 2, the skin parts 4, and the circumferential wall parts 5, the plurality of skin bodies 3 cover the entire outer wall surface of the ball main body 2. When a person grabs the ball 1, the skin part 4 is easily recessed, and the ball 1 can be easily grabbed. Furthermore, a valley part based on the beveled part 6 is formed on a boundary between adjacent skin bodies 3, and a hand is held in the valley part, thereby making the ball 1 easy to be grabbed. Still further, with the valley part, it is possible to make the outer appearance of the ball 1 in a hand-stitch style.

Figure 3:
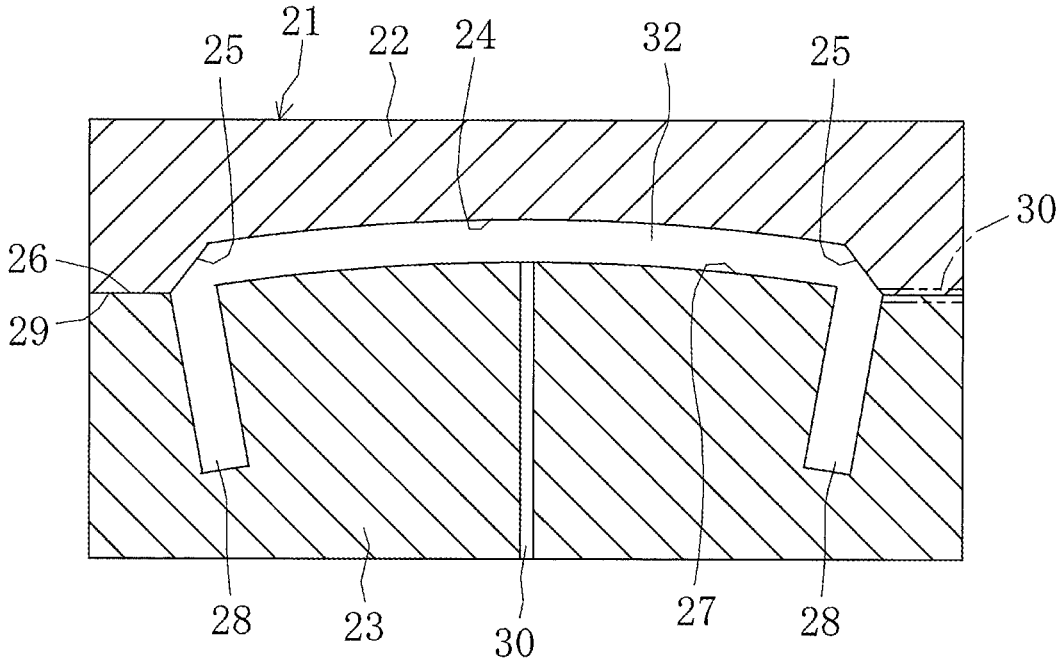
FIG. 3 is a sectional view depicting a clamped state of an injection mold for use in manufacturing the skin body according to the first embodiment.
Figure 4:
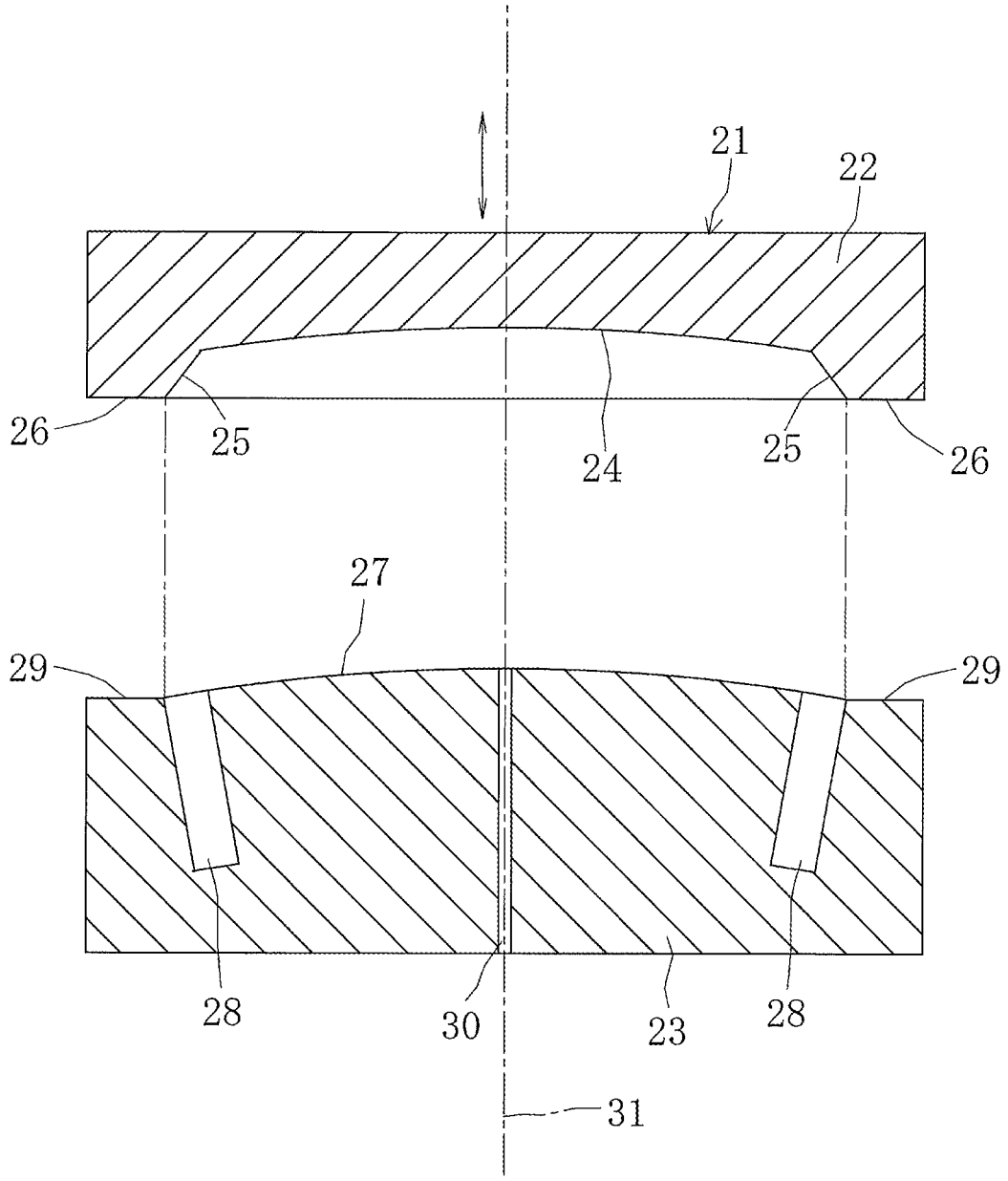
FIG. 4 is a sectional view depicting a mold opening state of the mold for use in manufacturing the skin body according to the first embodiment.

With reference to FIG. 3 and FIG. 4, a method of manufacturing the skin body 3 depicted in FIG. 2 by injection molding is described. FIG. 4 depicts a mold opening state of a mold 21. In FIG. 4, the mold 21 includes a first mold 22 and a second mold 23. The first mold 22 includes a main-body outer wall surface part 24, a beveled wall surface part 25, and a divisional surface part 26. The second mold 23 includes a main-body inner wall surface part 27, a circumferential wall recessed part 28, a divisional surface part 29, and a gate 30. And, when the first mold 22 moves along a straight line 31 to a second mold 23 side to cause the divisional surface parts 26 and 29 to be bound together, the mold 21 is in a state of being clamped depicted in FIG. 3, thereby configuring a molding space part 32 inside the mold 21.

In FIG. 3, after a soft material made of melted thermoplastic resin, thermosetting resin, or rubber is injected from the gate 30 into the molding space part 32 and solidified, the skin body 3 in the shape depicted in FIG. 2 can be obtained by mold opening as a molded article. Note that it is possible to apply the gate 30 provided on the divisional surface parts 26 and 29 as indicated by virtual lines.

Figure 5:
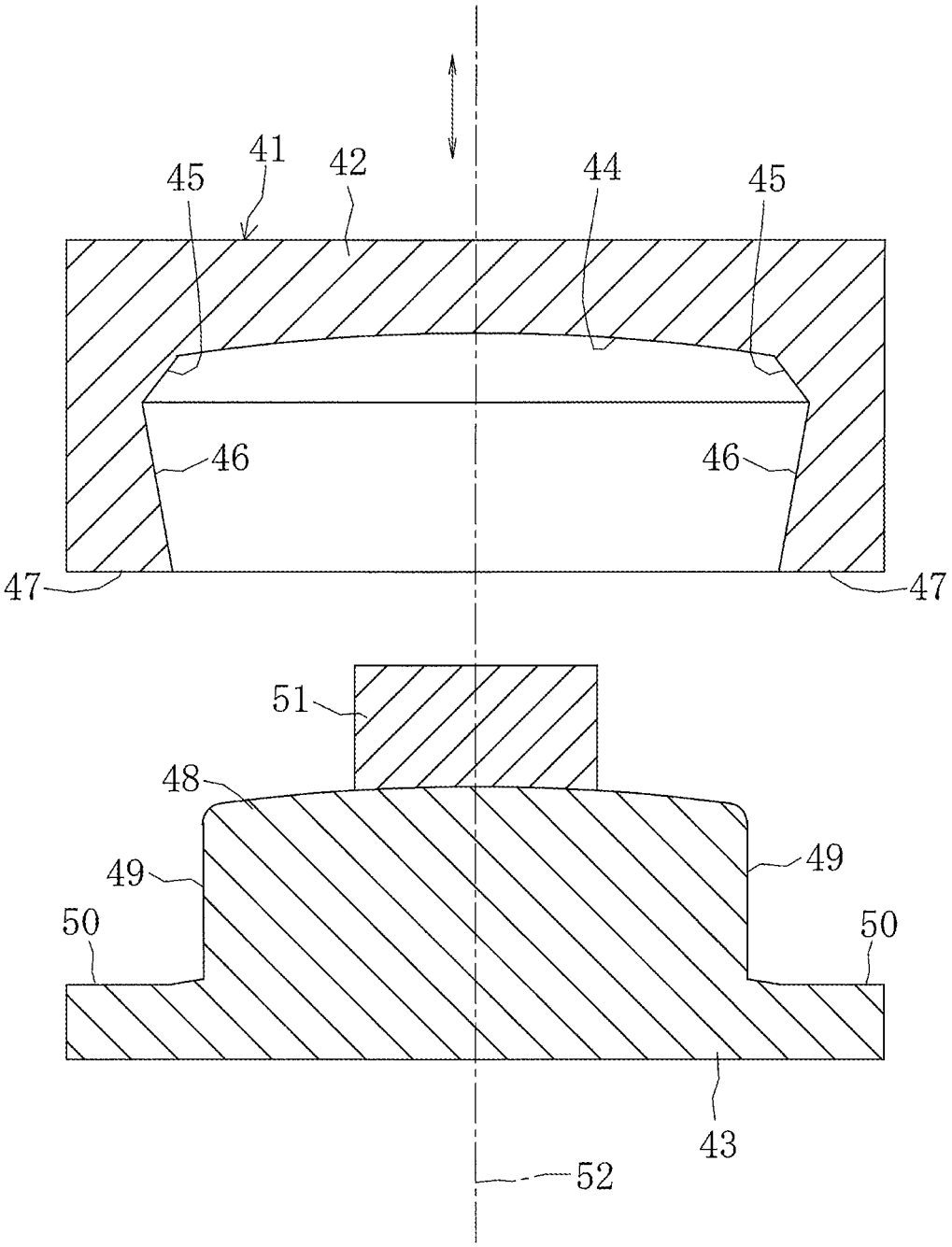
FIG. 5 is a sectional view depicting a mold opening state of a mold for use in manufacturing a skin body according to a second embodiment.
Figure 6:
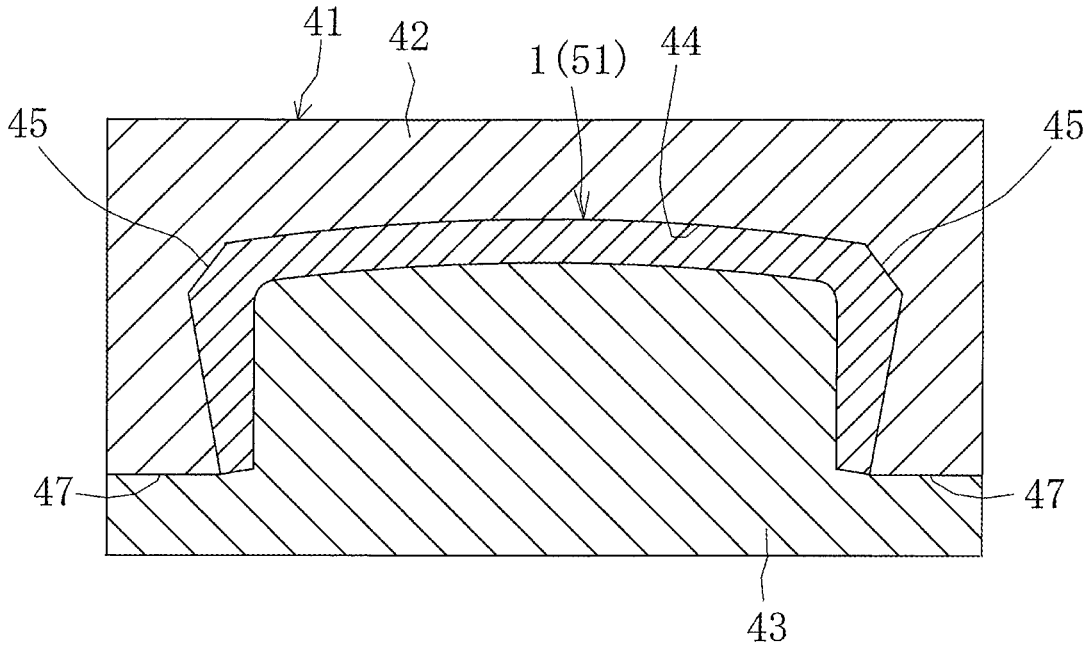
FIG. 6 is a sectional view of a clamped state of the mold for use in manufacturing the skin body according to the second embodiment.
Figure 7:
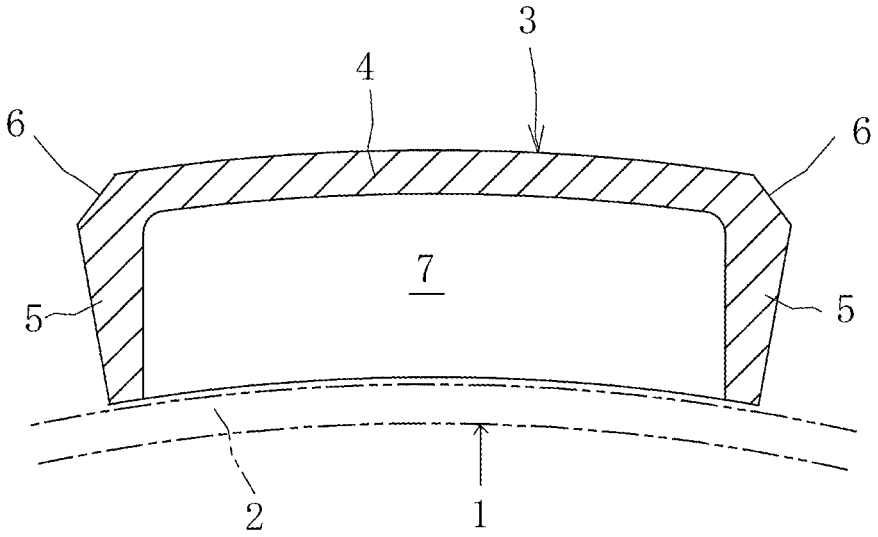
FIG. 7 is a sectional view partially depicting a ball according to the second embodiment having a skin body affixed to a ball main body, as being cut in a diameter direction of the ball.

With reference to FIG. 5 to FIG. 7, a method of manufacturing a skin body 3 according to a second embodiment by press molding is described. FIG. 5 depicts a mold opening state of a mold 41. In FIG. 5, the mold 41 includes a first mold 42 and a second mold 43. The first mold 42 includes a main-body outer wall surface part 44, a beveled wall surface part 45, and a circumferential-wall outer wall surface part 46, and a divisional surface part 47. The second mold 43 includes a main-body inner wall surface part 48, a circumferential-wall inner wall surface part 49, and a divisional surface part 50.

In the case of press molding, in a mold opening state of the mold 41, a block soft material 51 made of softened thermoplastic resin, thermosetting resin, or rubber is mounted on the second mold 43. Then, as the first mold 42 descends along a straight line 52 to a second mold 43 side, as depicted in FIG. 6, the soft material 51 receives pressure as being interposed between the first mold 42 and the second mold 43, and the mold 41 becomes in a state of being clamped. After solidification, by mold opening, the skin body 3 in the shape depicted in FIG. 7 can be obtained as a molded article.

Figure 8:
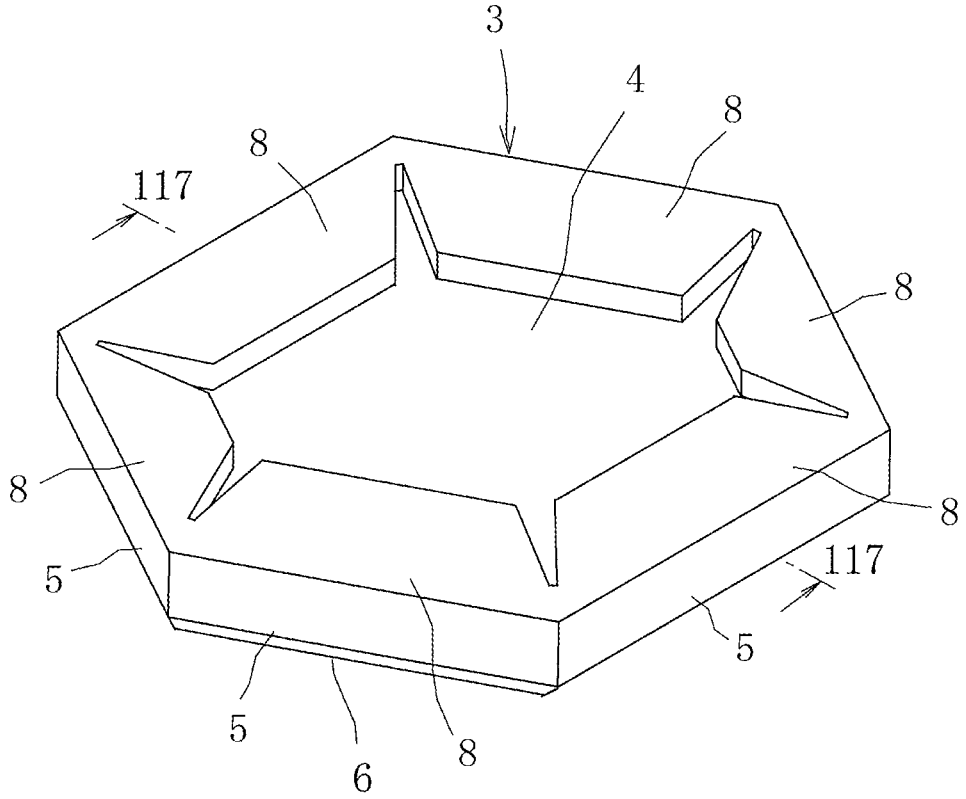
FIG. 8 is a perspective view depicting a skin body according to a third embodiment on a back surface side.
Figure 9:
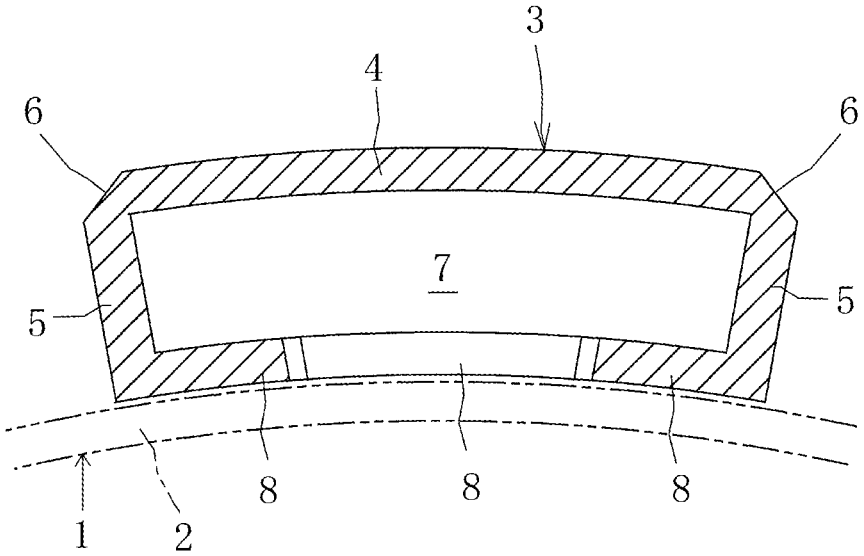
FIG. 9 is a sectional view partially depicting a ball according to the third embodiment having the skin body affixed to a ball main body, as being cut in a diameter direction of the ball.

With reference to FIG. 8 and FIG. 9, a skin body 3 according to a third embodiment is described. The skin body 3 depicted in FIG. 8 and FIG. 9 is configured to have a bulging part 8 extending from a circumferential wall part 5 to a center part side. The bulging part 8 is separated from the skin part 4. That is, the structure is such that the bulging part 8 configured to extend from the circumferential wall part 5 to the center part side and be separated from a skin part 4 is provided on a back side of the skin body 3. With this structure, with the bulging part 8 bonded to a ball main body 2 as depicted in FIG. 9, the area of bonding to the ball main body 2 is widened, compared with a structure in which the surface of the circumferential wall part 5 on a ball main body 2 side is bonded to the ball main body 2 depicted in FIG. 2, and bonding strength is increased.

Note that a structure is applicable to a mold for use at the time of injection molding of the skin body 3 depicted in FIG. 8 and FIG. 9, the structure in which the mold a molding space part for forming the bulging part 8 is provided to the mold 21 depicted in FIG. 3 and FIG. 4 so as to continue to the circumferential wall recessed part 28.

Figure 10:
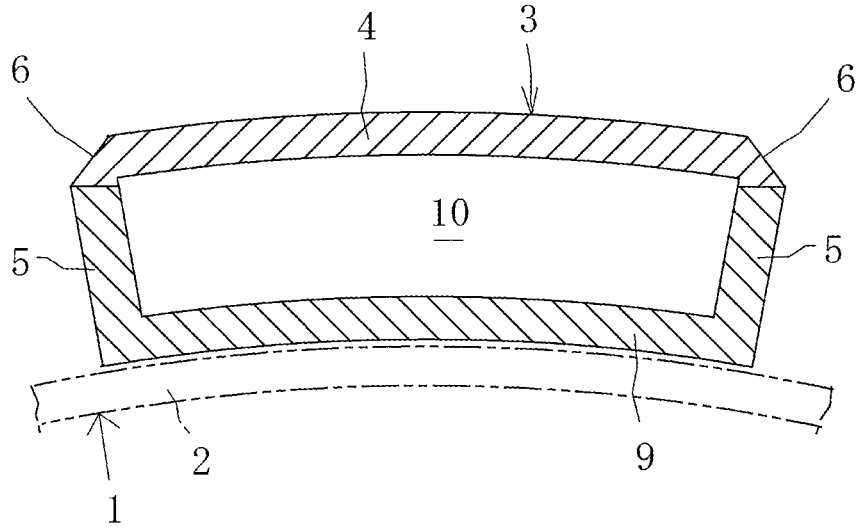
FIG. 10 is a sectional view partially depicting a ball according to a fourth embodiment having a skin body affixed to a ball main body.

With reference to FIG. 10, a skin body 3 according to a fourth embodiment is described. The skin body 3 depicted in FIG. 10 is configured to have a bottom part 9 formed over a circumferential wall part 5 and a cavity part 10 surrounded by a skin part 4, a circumferential wall part 5, and the bottom part 9. That is, the structure is such that the bottom part 9 is formed over the circumferential wall part 5 and the cavity part 10 configured to be surrounded by the skin part 4, the circumferential wall part 5, and the bottom part 9 is provided inside the skin body 3. With this structure, since the bottom part 9 is bonded to the ball main body 2, bonding strength is increased.

Figure 11:
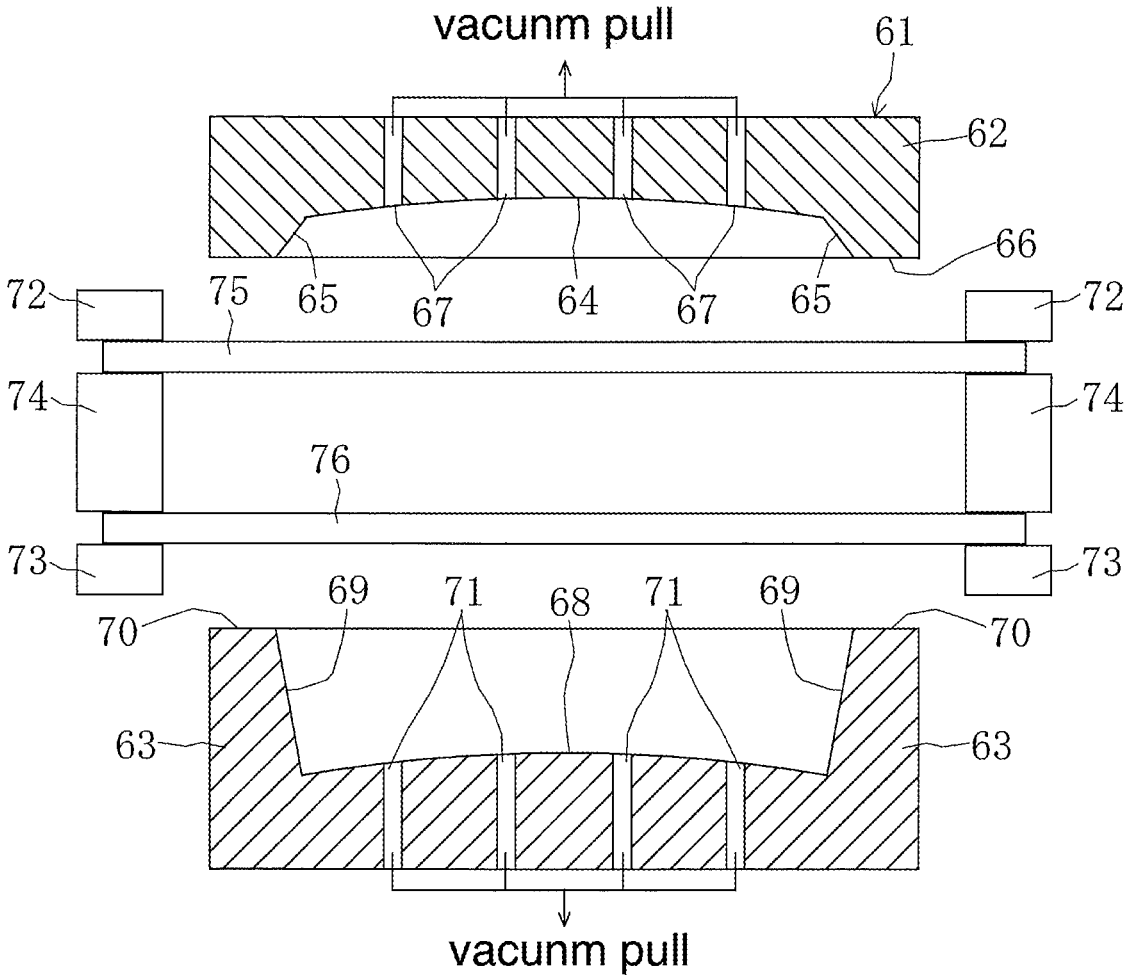
FIG. 11 is a sectional view depicting an mold opening state of a mold for use in manufacturing the skin body according to the fourth embodiment.

With reference to FIG. 11, a method of manufacturing the skin body 3 depicted in FIG. 10 by vacuum forming is described. FIG. 11 depicts a mold opening state of a mold 61. In FIG. 11, the mold 61 includes a first mold 62 and a second mold 63. The first mold 62 includes a main-body outer wall surface part 64, a beveled wall surface part 65, a divisional surface part 66, and a suction hole part 67. The second mold 63 includes a bottom surface part 68, a circumferential-wall outer wall surface part 69, a divisional surface part 70, and a suction hole part 71. By an upper clamp 72, a lower clump 73, and a spacer 74 in a vacuum forming facility, two plate-shaped soft materials 75 and 76 made of thermoplastic resin are supported, and the materials 75 and 76 are heated to be softened.

Then, in a process in which the first mold 62 and the second mold 63 move to a direction of facing each other, the divisional surface parts 66 and 70 are caused to face each other, and the mold 61 becomes in a state of being clamped, the suction hole part 67 causes the material 75 to be elongated by evacuating operation from a suction mechanism to be brought into close contact with the main-body outer wall surface part 64, the beveled wall surface part 65, and the divisional surface part 66 of the first mold 62, the suction hole part 71 causes the material 76 to be elongated by evacuating operation from the suction mechanism to be brought into close contact with the bottom surface 68, the circumferential-wall outer wall surface part 69, and the divisional surface part 70 of the second mold 63, and the skin body 3 in a shape depicted in FIG. 10 can be thereby obtained as a molded article.

Figure 12:
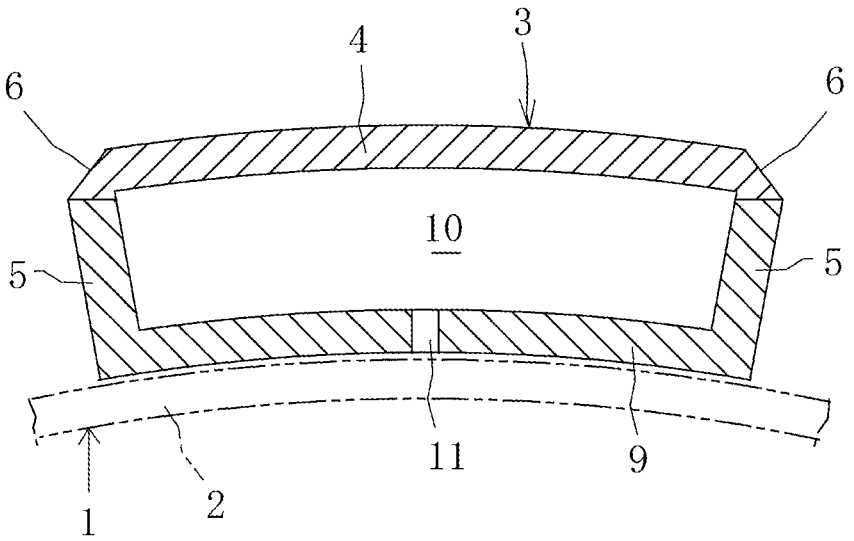
FIG. 12 is a sectional view partially depicting a ball according to a fifth embodiment having a skin body affixed to a ball main body, as being cut in a diameter direction of the ball.

With reference to FIG. 12, a skin body 3 according to a fifth embodiment is described. The skin body 3 depicted in FIG. 12 is configured to have a bottom part 9 formed over a circumferential wall part 5 and a cavity part 10 surrounded by a skin part 4, the circumferential wall parts 5, and the bottom part 9. The skin body 3 depicted in FIG. 12 is different from the skin body 3 depicted in FIG. 10 in structure that an aperture part 11 left when compressed air is blown is provided in the bottom part 9. Therefore, since the bottom part 9 is affixed to a ball main body 2 with a bonding agent not depicted, bonding strength is increased.

Figure 13:
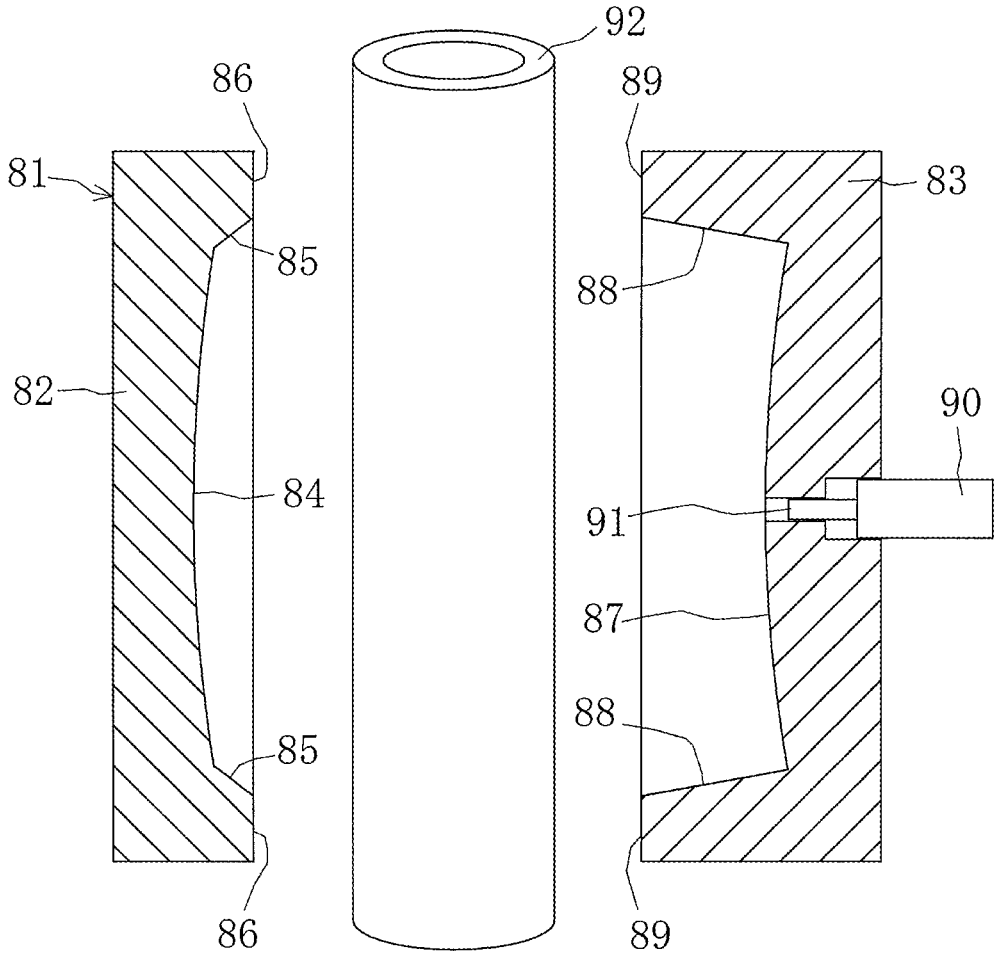
FIG. 13 is a sectional view depicting an mold opening state of a mold for use in manufacturing the skin body according to the fifth embodiment.
Figure 14:
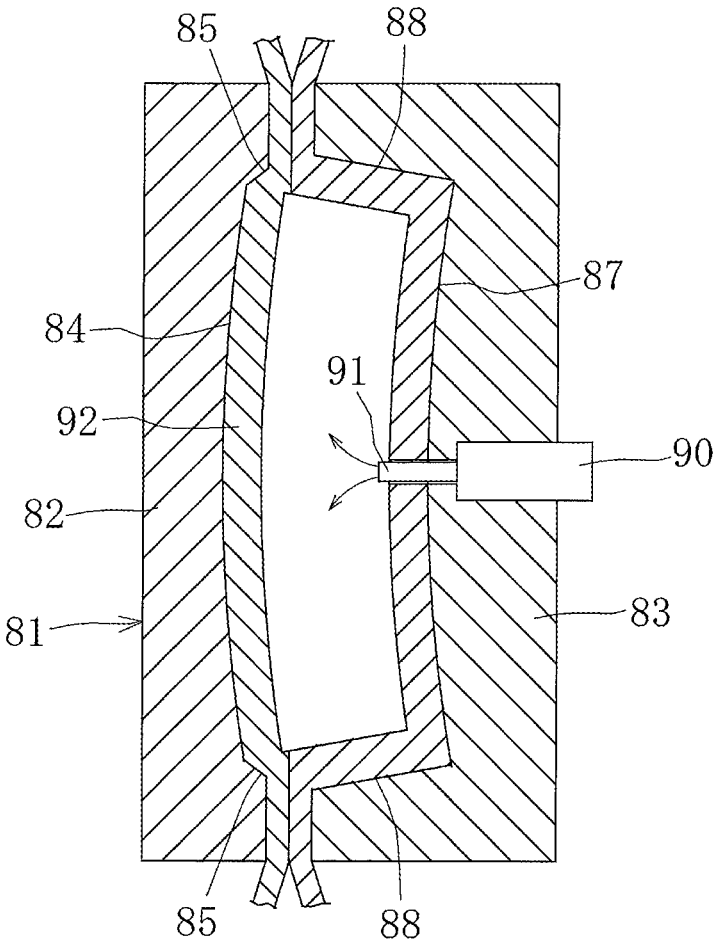
FIG. 14 is a sectional view depicting a clamped state of the mold for use in manufacturing the skin body according to the fifth embodiment.

With reference to FIG. 13 and FIG. 14, a method of manufacturing the skin body 3 depicted in FIG. 12 by blow molding is described. FIG. 13 depicts a mold opening state of a mold 81. In FIG. 13, the mold 81 includes a first mold 82 and a second mold 83. The first mold 82 includes a main-body outer wall surface part 84, a beveled wall surface part 85, and a divisional surface part 86. The second mold 83 includes a bottom surface part 87, a circumferential-wall outer wall surface part 88, a divisional surface part 89, and an air blowing mechanism 90. The air blowing mechanism 90 includes a nozzle 91.

And, a cylindrical parison 92 made of thermoplastic resin and produced by an extruding machine is placed between the first mold 82 and the second mold 83. Then, the first mold 82 and the second mold 83 move in a direction of facing each other, the divisional surface parts 86 and 89 are caused to face each other, and the mold 81 becomes in a state of being clamped.

Subsequently, as depicted in FIG. 14, the nozzle 91 of the air blowing mechanism 90 is inserted inside the parison 92, and compressed air is blown inside the prison 92 from the nozzle 91 to elongate the parison 92 to be brought into close contact with the main-body outer wall surface part 84 and the beveled wall surface part 85 of the first mold 82 and the bottom surface part 87 and the circumferential-wall outer wall surface part 88 of the second mold 83, and thereby a hollow molded article by the parison 92 can be obtained. Then, after the mold 81 is mold-opened and the hollow molded article by the parison 92 is released, trimming for removing an unwanted portion is performed, and thereby the skin body 3 depicted in FIG. 12 can be obtained.

Figure 15:
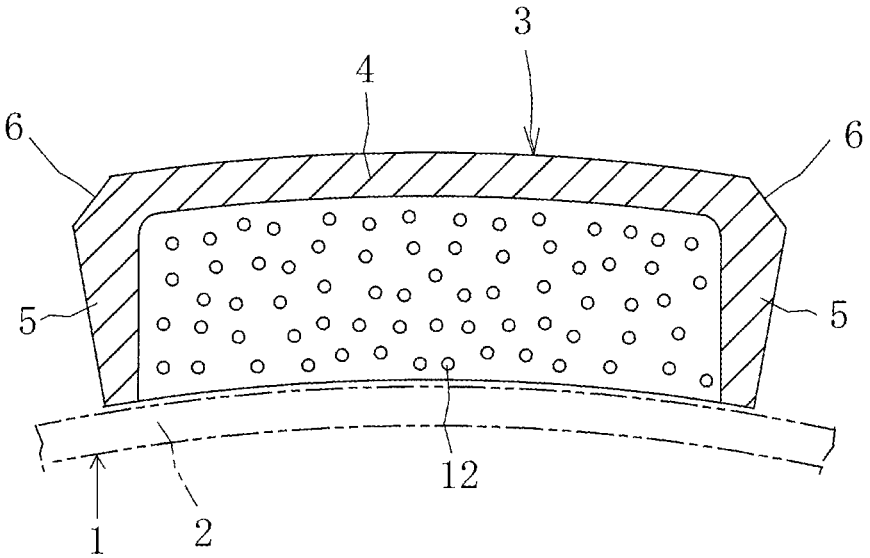
FIG. 15 is a sectional view partially depicting a ball according to a sixth embodiment having a skin body affixed to a ball main body, as being cut in a diameter direction of the ball.

With reference to FIG. 15, a skin body 3 according to a sixth embodiment is described. The skin body 3 depicted in FIG. 15 is configured to include a foam region part 12 having closed cells in a region surrounded by a skin part 4 and a circumferential wall part 5. That is, the structure is such that the foam region part 12 configured to be surrounded by the skin part 4 and the circumferential wall part 5 is integrally formed inside the skin body 3. With this structure, when a person grabs a ball 1, the touch feeling of grabbing the ball 1 is improved. Also, since the circumferential wall part 5 and the foam region part 12 are affixed to a ball main body 2 with a bonding agent not depicted, bonding strength is increased.

Figure 16:
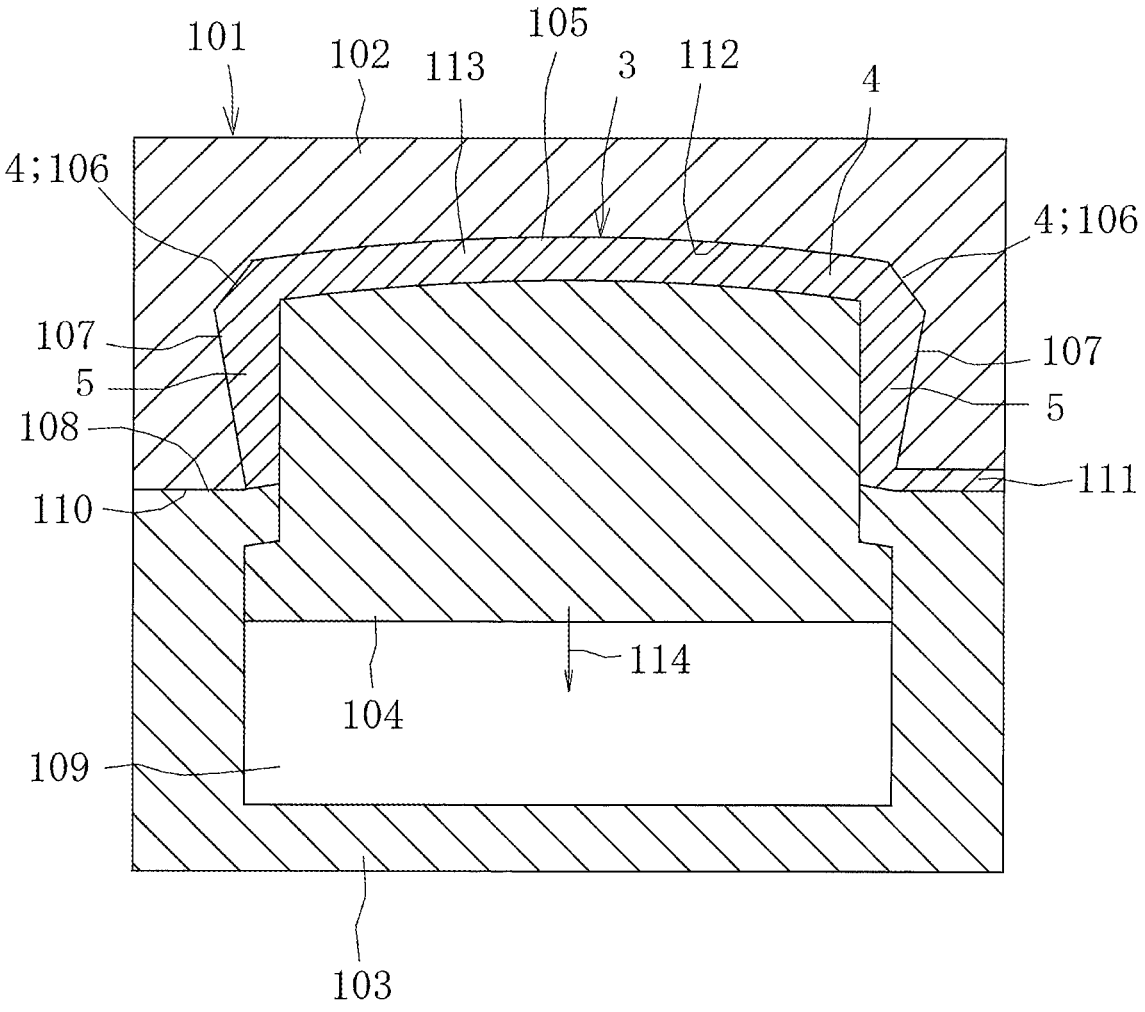
FIG. 16 is a sectional view depicting a state in which capacity of a molding space part of a mold for use in manufacturing the skin body according to the sixth embodiment is reduced.
Figure 17:
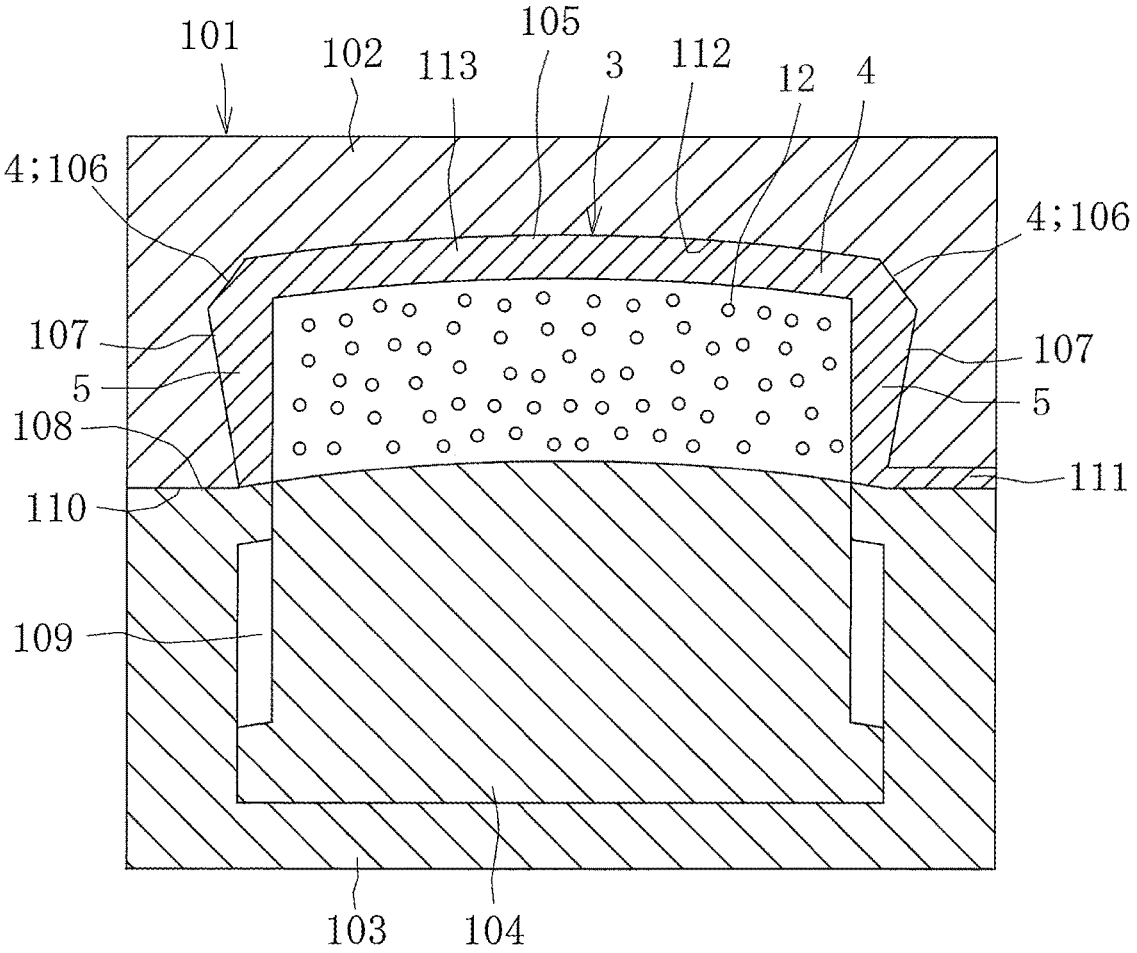
FIG. 17 is a sectional view depicting a state in which capacity of the molding space part of the mold for use in manufacturing the skin body according to the sixth embodiment is enlarged.

With reference to FIG. 16 and FIG. 17, a method of manufacturing the skin body 3 depicted in FIG. 15 by core back molding of injection molding is described. FIG. 16 depicts a state in which a slide core 104 of a mold 101 reduces the capacity of a molding space part 112. In FIG. 16, the mold 101 includes a first mold 102, a second mold 103, and the slide core 104. The first mold 102 includes a main-body outer wall surface part 105, a beveled wall surface part 106, a circumferential-wall outer wall surface part 107, and a divisional surface part 108. The second mold 103 includes a core accommodating part 109 and a divisional surface part 110. In the core accommodating part 109, the slide core 104 is accommodated. On divisional surface parts 108 and 110 sides, a gate 111 is provided.

As depicted in FIG. 16, in a state in which the molding space part 112 is configured of the main-body outer wall surface part 105, the beveled wall surface part 106, the circumferential-wall outer wall surface part 107, and the slide core 104 and the slide core 104 reduces the capacity of the molding space part 112, a mold material 113 made of melted thermoplastic resin is injected from a cylinder of an injection molding machine via the gate 111 to the molding space part 112. In this injected mold material 113, a foaming agent or the like is mixed. Before the mold material 113 injected to the molding space part 112 is solidified, the slide core 104 moves in a direction away from the skin part 4 of the skin body 3 as indicated by an arrow 114.

With the movement of the slide core 104 described above, as depicted in FIG. 17, the capacity of the molding space part 112 is enlarged, the foaming agent or the like contained in the mold material 113 effervesces, and the foam region part 12 with air holes is formed. The resulting foam region part 12 has substantially consistent compressibility due to a uniform distribution of the foam region part 12 and the distribution of air holes. With this, the skin body 3 depicted in FIG. 15 can be obtained.

Figure 18:
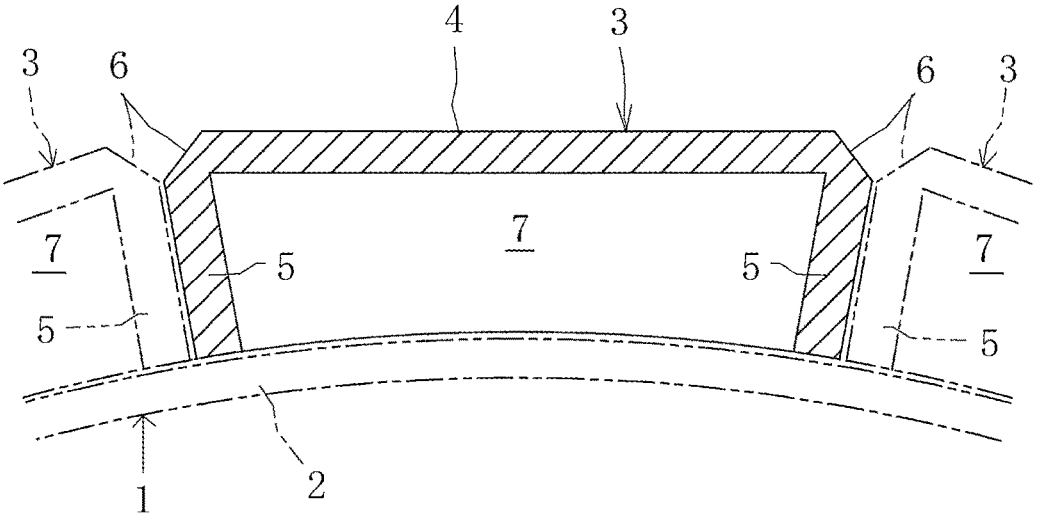
FIG. 18 is a sectional view partially depicting a ball according to a seventh embodiment having a skin body affixed to a ball main body, as being cut in a diameter direction of the ball.

With reference to FIG. 18, a skin body 3 of a ball 1 according to a seventh embodiment is described. The skin body 3 depicted in FIG. 18 is different from the skin body 3 depicted in FIG. 2 in structure that the skin part 4 is in a flat plate shape.

Figure 19:
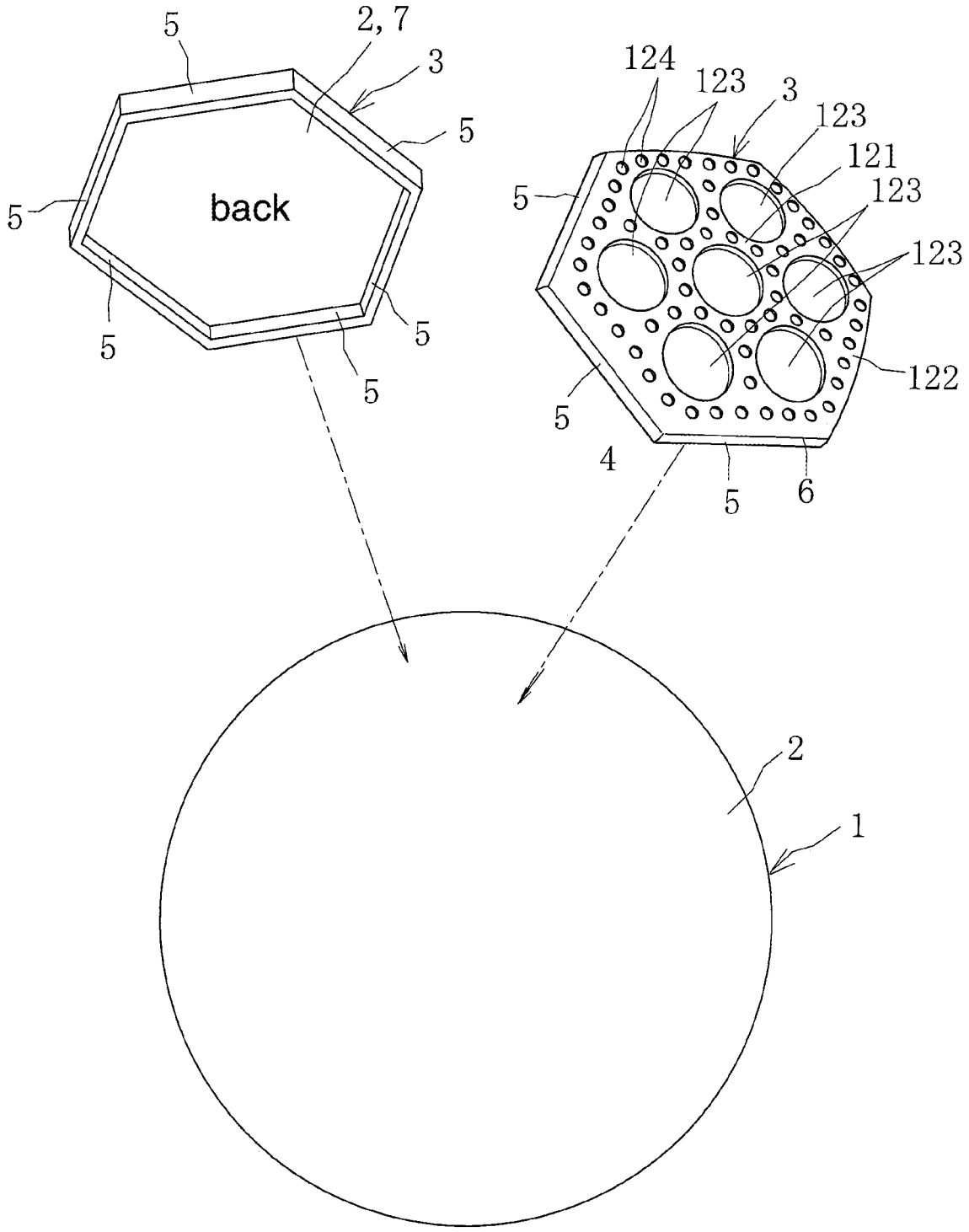
FIG. 19 is a perspective view depicting a ball according to an eighth embodiment exploded into a ball main body and a skin body.

With reference to FIG. 19, a skin body 3 of a ball 1 according to an eighth embodiment is described. The skin body 3 depicted in FIG. 19 is described. A skin part 4 of the skin body 3 includes a flat surface part 121 at a center part and a tilted surface part 122 surrounding the flat surface part 121.

When the skin body 3 is affixed to a ball main body 2, the flat surface part 121 tends to become a curved surface with a large radius of curvature. Therefore, the flat surface part 121 is assumed to include both of a structure of being formed of a flat surface and a structure of being formed of a curved surface with a large radius of curvature approximating to a flat surface. The tilted surface part 122 configures a tilt gradually inclined downward from a flat surface part 121 side to a beveled part 6 side.

On a front surface of the skin part 4, large recessed parts 123 and small recessed parts 124 are configured as depressions from the front surface side of the skin part 4 toward the inside of the skin body 3. The number of large recessed parts 123 is not restricted to the following numerical values, but one example when the skin body 3 was prototyped is described. The structure is such that seven large recessed parts 123 are provided in total, one in a center part of the flat surface part 121 of the skin part 4 and six in a peripheral part thereof, and many small recessed parts 124 are provided so as to surround each of the seven large recessed parts 123 individually and be scattered along the flat surface part 121 and the tilted surface part 122. The six large recessed parts 123 in the peripheral part are configured to be arranged on straight lines connecting the center part of the skin part 4 and six corner parts in the skin part 4.

Figure 21:
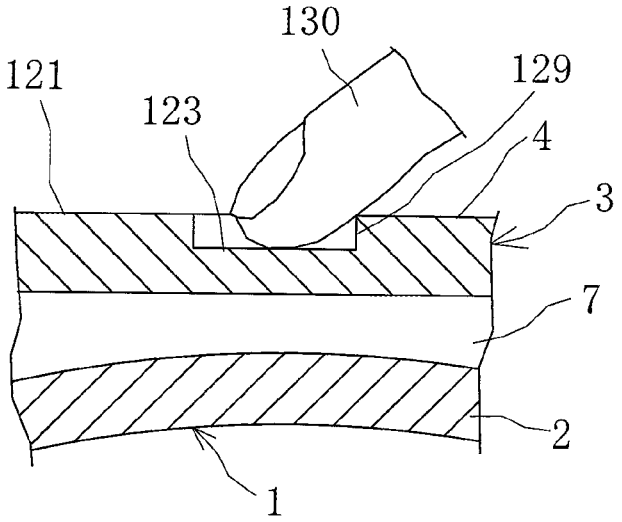
FIG. 21 is a schematic view depicting a state in which a finger is hung on a recessed part of the ball according to the eighth embodiment.

As depicted in FIG. 21, the large recessed part 123 configures a step part 129 where a finger is hung. Specifically, a bottom part of the large recessed part 123 configures a low portion of the step part 129, and a periphery of the large recessed part 123 on the front surface of the skin body 3 configures a high portion of the step part 129.

The small recessed parts 124 depicted in FIG. 19 configure a portion which provides a non-slippery property. However, a structure without being provided with the small recessed parts 124 can also be applied. As a portion which provides a non-slippery property, in place of the small recessed parts 124, wrinkles may be provided on the front surface of the skin body 3, and a structure formed of the small recessed parts 124 and wrinkles can also be applied. With the small recessed parts 124 letting out sweat, the non-slippery property can be provided more, and flexibility of the skin body 3 can be improved to allow easy grabbing. Also, a non-slippery property can be provided also by providing small protruding parts not depicted, in place of the small recessed parts 124.

Note that the arrangement mode of the large recessed parts 123 and the small recessed parts 124 is not restricted to the arrangement mode in the above description and any arrangement is possible.

Figure 20:
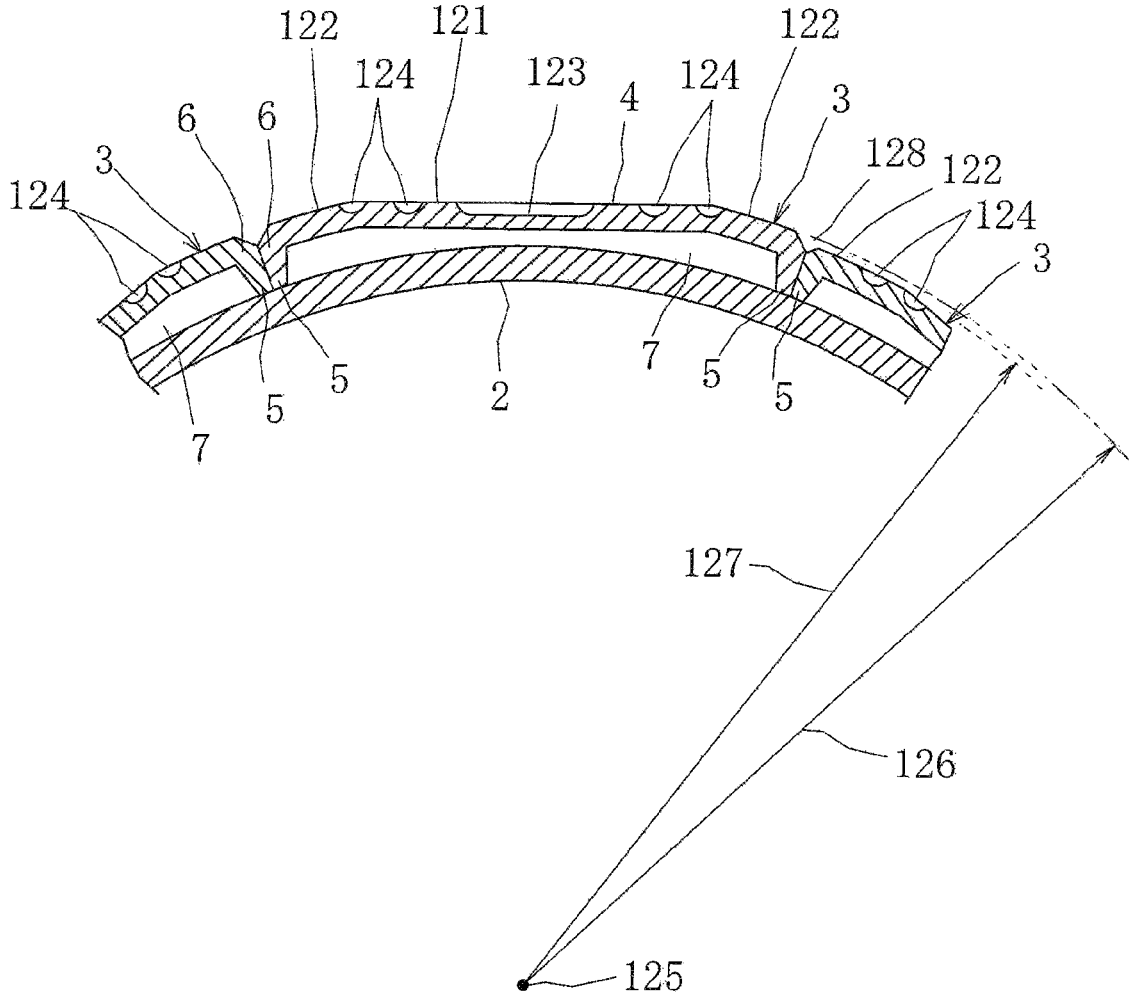
FIG. 20 is a sectional view partially depicting the ball according to the eighth embodiment having the skin body affixed to the ball main body, as being cut in a diameter direction of the ball.

As depicted in FIG. 20, when a plurality of skin bodies 3 are attached to the ball main body 2, circumferential wall parts 5 of adjacent skin parts 3 are welded together or bonded with a bonding agent, surfaces of the adjacent circumferential wall parts 5 on a ball main body 2 side are welded or bonded with a bonding agent not depicted to an outer wall surface of the ball main body 2, adjacent skin parts 4 are arranged away from the outer wall surface of the ball main body 2, and a cavity part 7 is formed between the ball main body 2 and the skin body 3 as a space surrounded by the ball main body 2, the skin part 4, and the circumferential wall part 5.

In a state where the plurality of skin bodies 3 are attached to the ball main body 2, adjacent skin bodies 3 form a step part 128. That is, when it is assumed that a virtual circle centering at a center part 125 of the ball 1 has a radius 126 and a virtual circle of the tilted part 122 of one of the adjacent skin bodies 3 centering at the center part 125 of the ball 1 has a radius 127, one and the other of the adjacent skin bodies 3 are configured so that the tilted part 122 of the other of the adjacent skin bodies 3 is positioned closer to a ball main body 2 side than the radius 127, thereby configuring the step part 128 between the adjacent skin bodies 3. The tilted surface part 122 faces away from an axis that extends orthogonally through the flat surface part 121.

Therefore, in the ball 1 depicted in FIG. 20, with the cavity part 7 surrounded by the ball main body 2 and the skin body 3 between the ball main body 2 and the skin body 3, the skin body 3 is easily recessed when a person grabs the ball 1, and the ball 1 becomes easy to be grabbed. Also, with the valley part formed of the beveled part 6, the outer appearance of the ball 1 becomes in a hand-stitch style. Also, when the person grabs the ball 1, a finger is hung on the large recessed part 123 or the step part 128, or the flat surface part 121 is touched with a finger to make the person feel that the ball 1 has a small outer diameter. With this, the ball 1 becomes easy to be grabbed, and it becomes easy to throw and catch the ball 1. For example, as depicted in FIG. 21, when the person grabs the ball 1, if the tip of a finger 130 of the person grabbing the ball 1 enters the large recessed part 123, the pulp of the finger 130 is easy to be hung on the step part 129 around the large recessed part 123.

As depicted in FIG. 20, on a back surface of the skin body 3, the cavity part 7 surrounded by the skin part 4 and the boundary wall part 5 is provided. However, a structure without being provided with the cavity part 7 can be applied to the back surface of the skin body 3. When the cavity part 7 is not provided, if the back side of the skin body 3 is welded or bonded with a bonding agent not depicted to the front surface of the ball main body 2, even in a structure in which one or both of the large recessed parts 123 and small hole parts 124 penetrate through the front surface and the back surface of the skin body 3, moisture such as water or sweat is prevented from penetrating between the ball main body 2 and the skin body 3, and bonding strength is increased.

Figure 22:
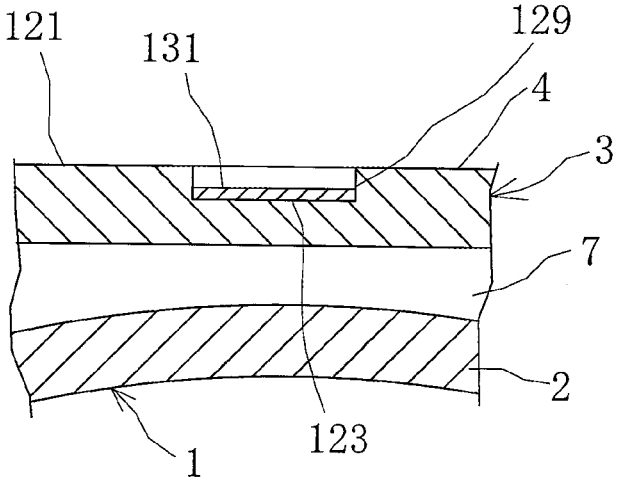
FIG. 22 is a sectional view depicting a structure in which a bonding material is provided to a recessed part of a ball according to a ninth embodiment.

With reference to FIG. 22, a skin body 3 of a ball 1 according to a ninth embodiment is described. The ball 1 depicted in FIG. 22 is configured to have an adhesion material 131 provided to a large recessed part 123 as a recessed part of the skin body 3. As a material of the adhesion material 131, a styrene-based elastomer, silicone-based elastomer, rubber-based elastomer, urethane-based elastomer, or the like can be applied. The adhesion material 131 is configured to be removably provided to the large recessed part 123 so as to be replaceable by a new one if adhesive strength is decreased with use.

Figure 23:
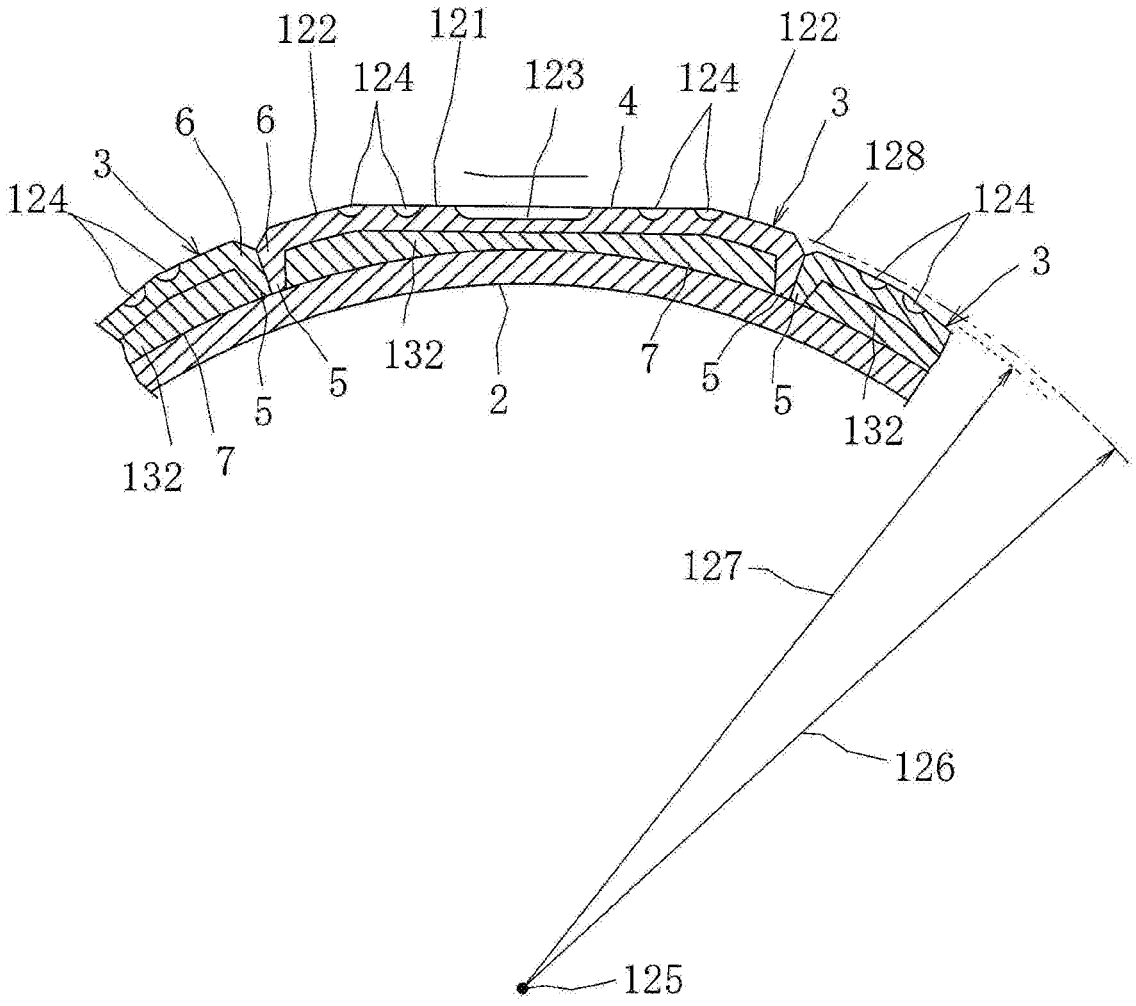
FIG. 23 is a sectional view partially depicting a ball according to a tenth embodiment having a skin body affixed to a ball main body, as being cut in a diameter direction of the ball.

With reference to FIG. 23, a skin body 3 of a ball 1 according to a tenth embodiment is described. Since the skin body 3 depicted in FIG. 23 is configured to have a cushion part 132 provided to a cavity part 7, when a person grabs the ball 1, the touch feeling of grabbing the ball 1 is improved. Also, although the cushion part 132 may not be bonded to a ball main body 2 with a bonding agent, if the cushion part 132 is bonded to the ball main body 2 with a bonding agent, bonding strength is increased. The cushion part 132 is configured of a cushioning material such as a foamed resin, nonwoven fabric, rubber, or elastomer.

Figure 24:
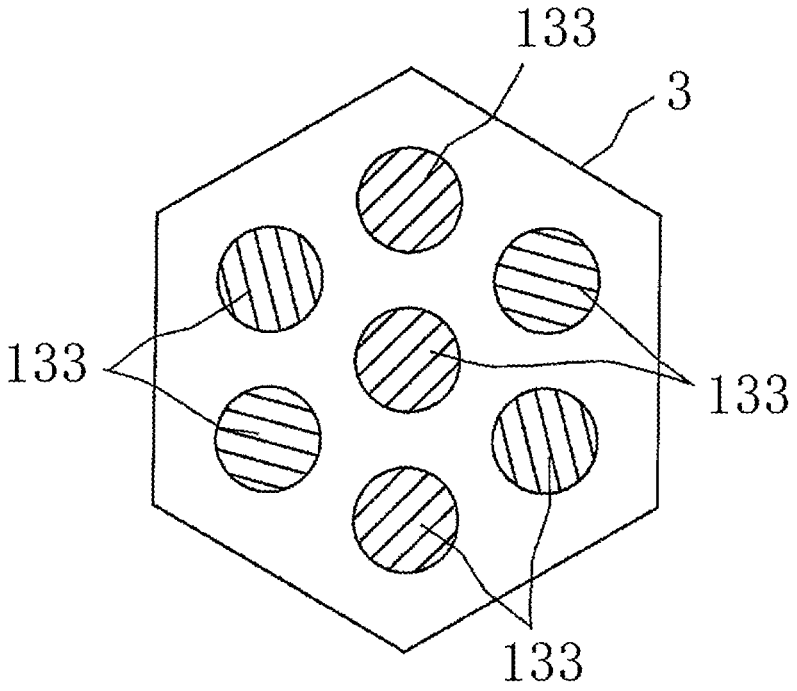
FIG. 24 is a plan view depicting the structure of step parts provided on a front surface of a skin body according to an eleventh embodiment.

FIG. 24 describes shaping of step parts provided to a skin body 3 according to an eleventh embodiment. On a front surface of the skin body 3 depicted in FIG. 24, a plurality of protruding parts 133 with diagonal lines are dispersedly provided, and thereby the front surface of the skin body 3 other than the protruding parts 133 is configured as a lower portion of the step parts. The number of protruding parts 133 is not restricted to seven, and may be one to six or eight or more. Also, the shape of the protruding part 133 when viewed from a flat surface is not restricted to a circle, and may be an oval shape or a polygonal shape. The plurality of protruding parts 133 may have a same height or different heights.

Figure 25:
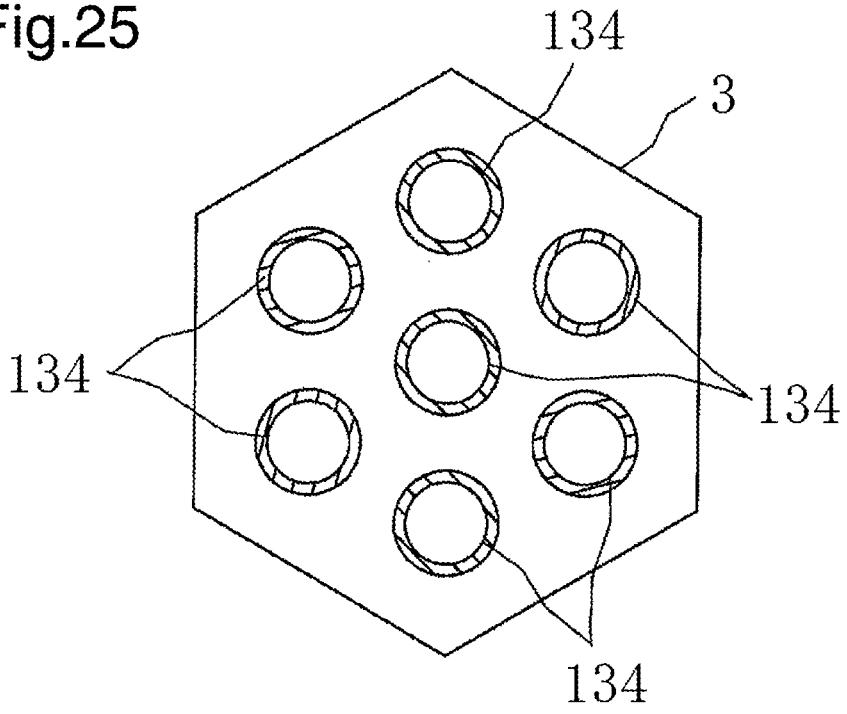
FIG. 25 is a plan view depicting the structure of step parts provided on a front surface of a skin body according to a twelfth embodiment.

FIG. 25 describes the structure of a step part provided to a skin body 3 according to a twelfth embodiment. On a front surface of the skin body 3 depicted in FIG. 25, a plurality of annular protruding parts 134 with diagonal lines are dispersedly provided, and thereby the front surface of the skin body 3 other than the protruding parts 134 is configured as a lower portion of the step parts. Also, the shape of the protruding part 134 when viewed from a flat surface is not restricted to a circle, and may be an oval shape or a polygonal shape. The plurality of protruding parts 134 may have a same height or different heights.

Figure 26:
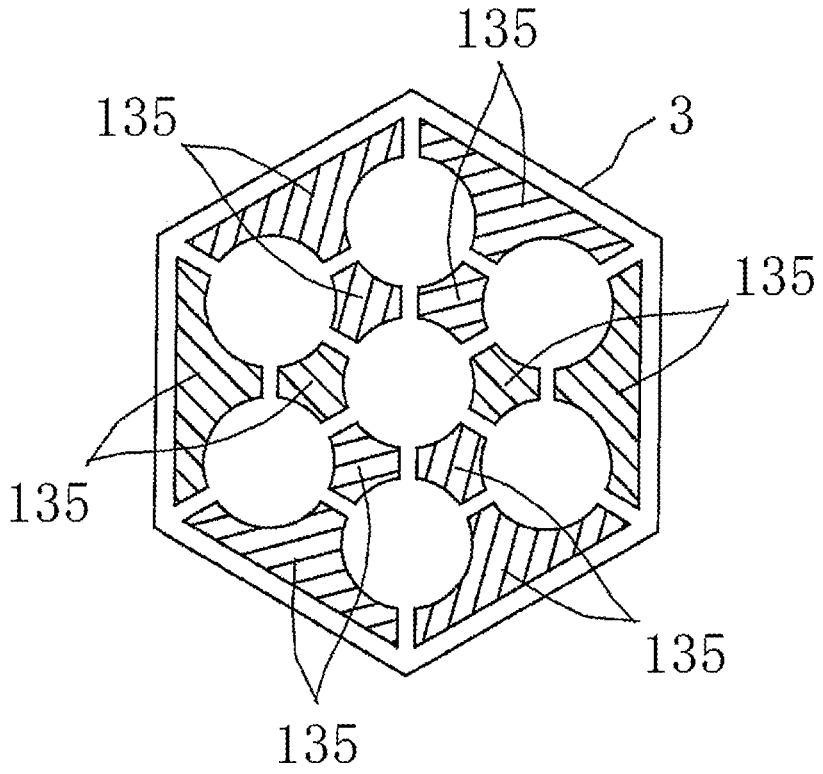
FIG. 26 is a plan view depicting the structure of step parts provided on a front surface of a skin body according to a thirteenth embodiment.

FIG. 26 describes shaping of step parts provided to a skin body 3 according to a thirteenth embodiment. On a front surface of the skin body 3 depicted in FIG. 26, a plurality of protruding parts 135 with diagonal lines are dispersedly provided, and thereby the front surface of the skin body 3 other than the protruding parts 135 is configured as a lower portion of the step parts. The plurality of protruding parts 135 may have a same height or different heights.

Figure 27:
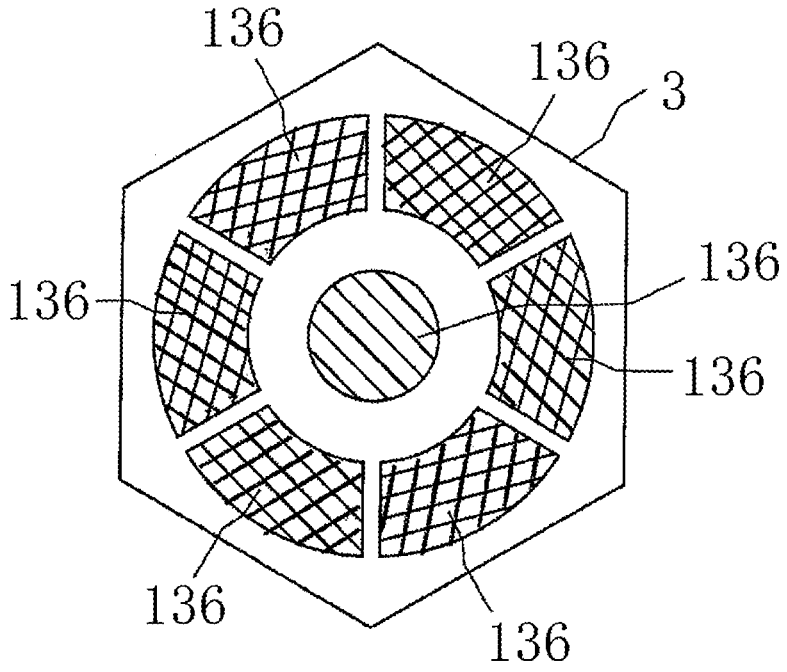
FIG. 27 is a plan view depicting the structure of step parts provided on a front surface of a skin body according to a fourteenth embodiment.

FIG. 27 describes shaping of step parts provided to a skin body 3 according to a fourteenth embodiment. On a front surface of the skin body 3 depicted in FIG. 27, a plurality of recessed parts 136 with lines for meshing are dispersedly provided, and thereby the recessed parts 136 are configured as a lower portion of the step parts. Also, the shape of the recessed part 136 when viewed from a flat surface is not restricted to a circle or arc shape, and may be an oval shape or a polygonal shape. The plurality of recessed parts 136 may have a same depth or different depths.

Figure 28:
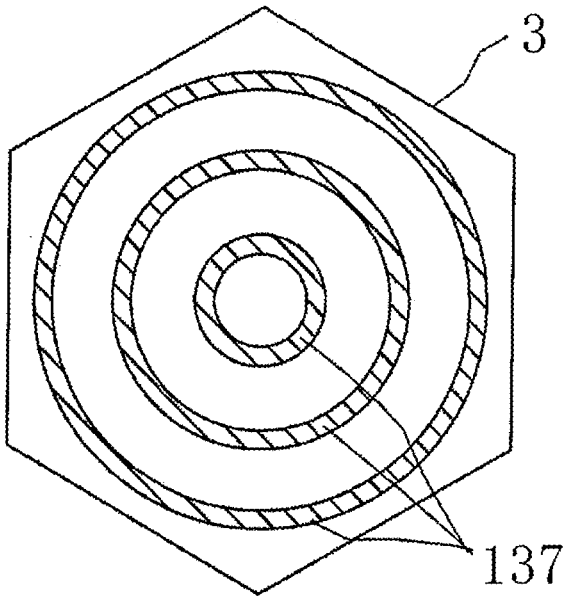
FIG. 28 is a plan view depicting the structure of step parts provided on a front surface of a skin body according to a fifteenth embodiment.

FIG. 28 describes shaping of step parts provided to a skin body 3 according to a fifteenth embodiment. On a front surface of the skin body 3 depicted in FIG. 28, a plurality of annular protruding parts 137 with diagonal lines are provided so as to configure a ripple shape, and thereby the front surface of the skin body 3 other than the protruding parts 137 is configured as a lower portion of the step parts. Also, the shape of the protruding part 137 when viewed from a flat surface is not restricted to a circle, and may be an oval shape, an arc shape, or a polygonal shape. The plurality of protruding parts 137 may have a same height or different heights.

Figure 29:
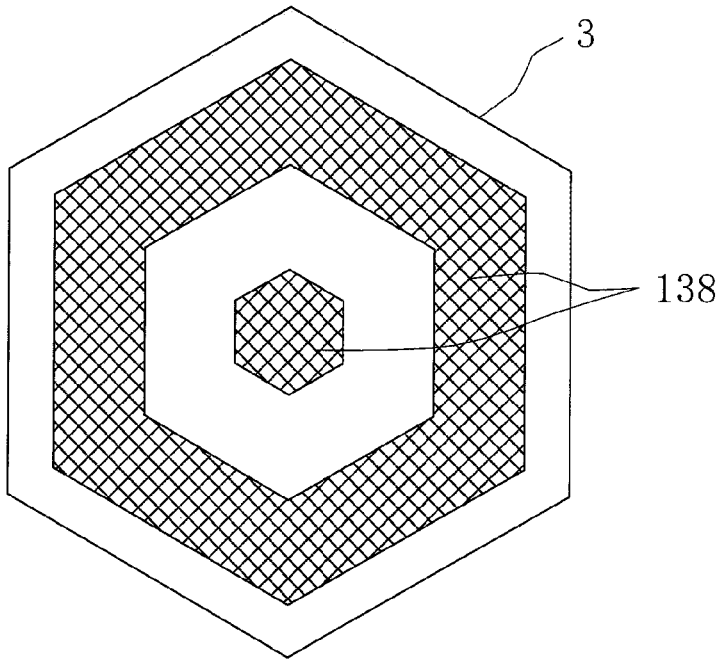
FIG. 29 is a plan view depicting the structure of step parts provided on a front surface of a skin body according to a sixteenth embodiment.

FIG. 29 describes shaping of step parts provided to a skin body 3 according to a sixteenth embodiment. On a front surface of the skin body 3 depicted in FIG. 29, a plurality of annular recessed parts 138 with lines for meshing are provided so as to configure a ripple shape, and thereby the recessed parts 138 are configured as a lower portion of the step parts. Also, the shape of the recessed part 138 when viewed from a flat surface is not restricted to a polygonal shape, and may be an oval shape, an arc shape, or a polygonal shape. The plurality of recessed parts 138 may have a same depth or different depths.

Figure 30:
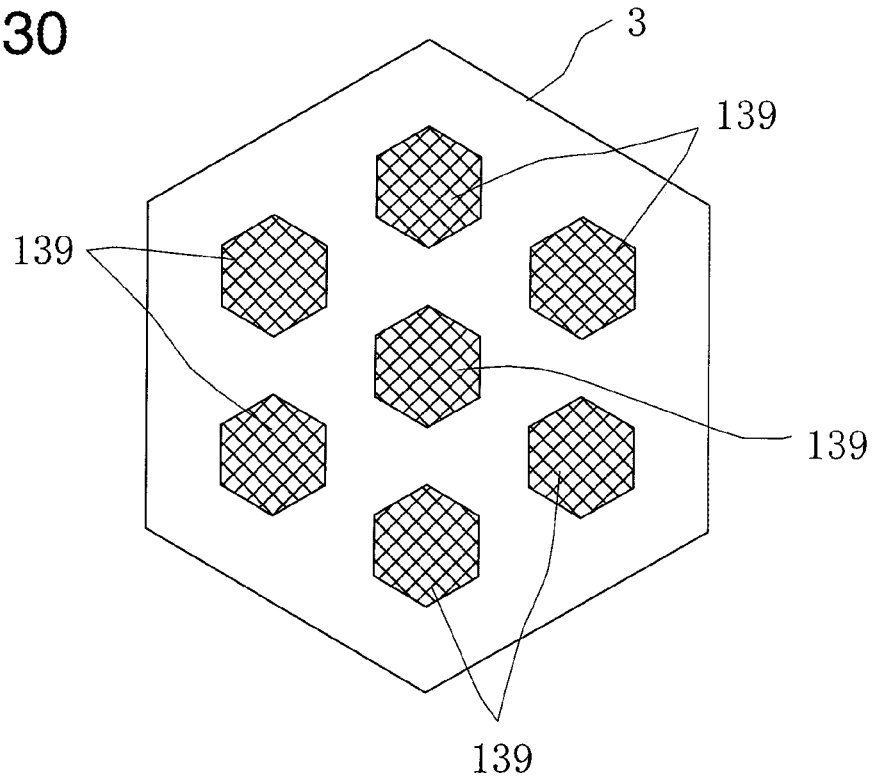
FIG. 30 is a plan view depicting the structure of step parts provided on a front surface of a skin body according to a seventeenth embodiment.

FIG. 30 describes shaping of step parts provided to a skin body 3 according to a seventeenth embodiment. On a front surface of the skin body 3 depicted in FIG. 30, a plurality of recessed parts 139 with lines for meshing are dispersedly provided, and thereby the recessed parts 139 are configured as a lower portion of the step parts. The number of recessed parts 139 is not restricted to six, and may be one to five or seven or more. Also, the shape of the recessed part 139 when viewed from a flat surface is not restricted to a circle or arc shape, and may be an oval shape or a polygonal shape. The plurality of recessed parts 139 may have a same depth or different depths.

Figure 31:
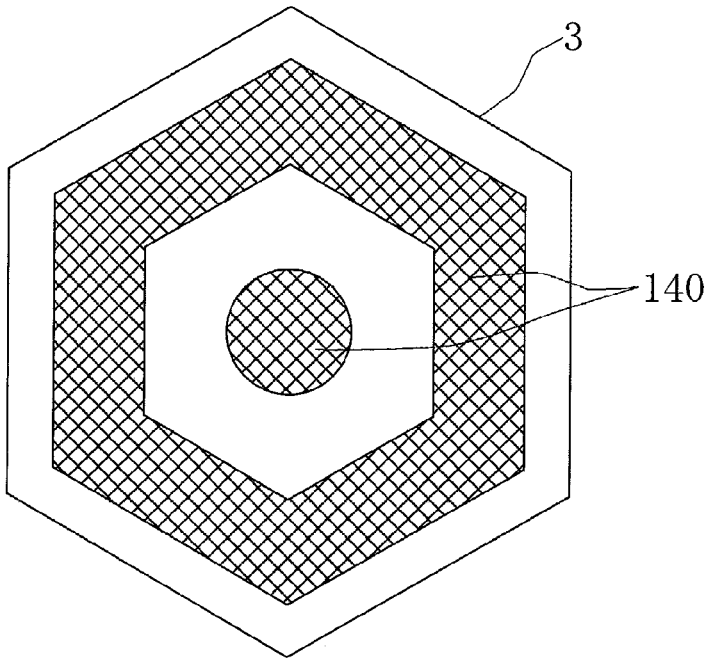
FIG. 31 is a plan view depicting the structure of step parts provided on a front surface of a skin body according to an eighteenth embodiment.

FIG. 31 describes shaping of step parts provided to a skin body 3 according to a eighteenth embodiment. On a front surface of the skin body 3 depicted in FIG. 31, a plurality of recessed parts 140 with lines for meshing are provided so as to configure a ripple shape, and thereby the recessed parts 140 are configured as step parts. The number of recessed parts 140 is not restricted to two, and may be one or three or more. Also, the shape of the inner circular recessed part 140 when viewed from a flat surface is not restricted to a circle, and may be an oval shape, an arc shape, or a polygonal shape. Furthermore, the shape of the outer annular recessed part 140 when viewed from the flat surface is not restricted to a polygonal shape, and may be a circle, an oval shape, or an arc shape. The plurality of recessed parts 140 may have a same depth or different depths.

Figure 32:
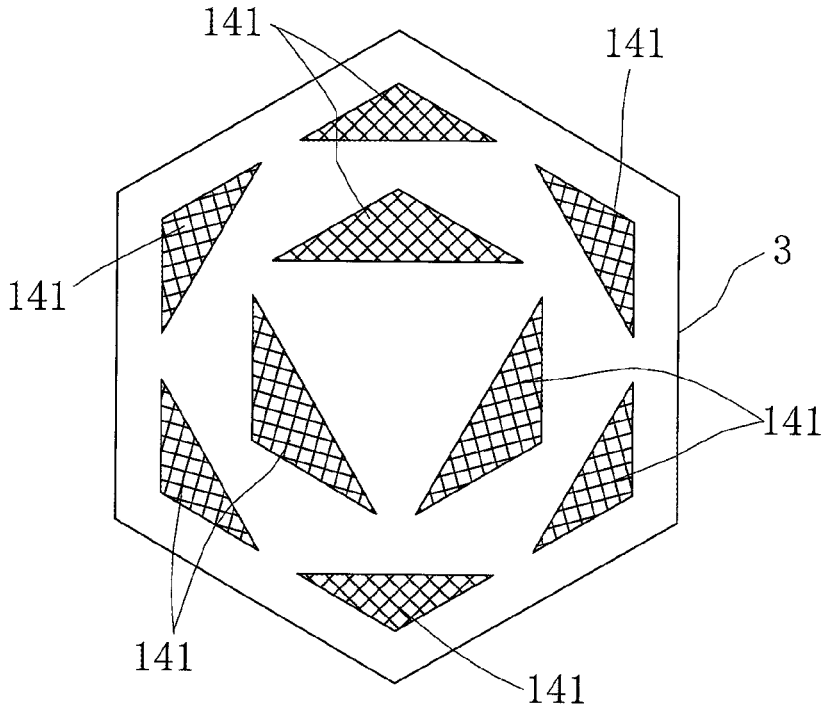
FIG. 32 is a plan view depicting the structure of step parts provided on a front surface of a skin body according to a nineteenth embodiment.

FIG. 32 describes shaping of step parts provided to a skin body 3 according to a nineteenth embodiment. On a front surface of the skin body 3 depicted in FIG. 32, a plurality of recessed parts 141 with lines for meshing are dispersedly provided, and thereby the recessed parts 141 are configured as a lower portion of the step parts. Also, the shape of the recessed part 141 when viewed from a flat surface is not restricted to a triangle, and may be a circle, an oval shape, an arc shape, or a polygonal shape other than a triangle. The plurality of recessed parts 141 may have a same depth or different depths.

Figure 33:
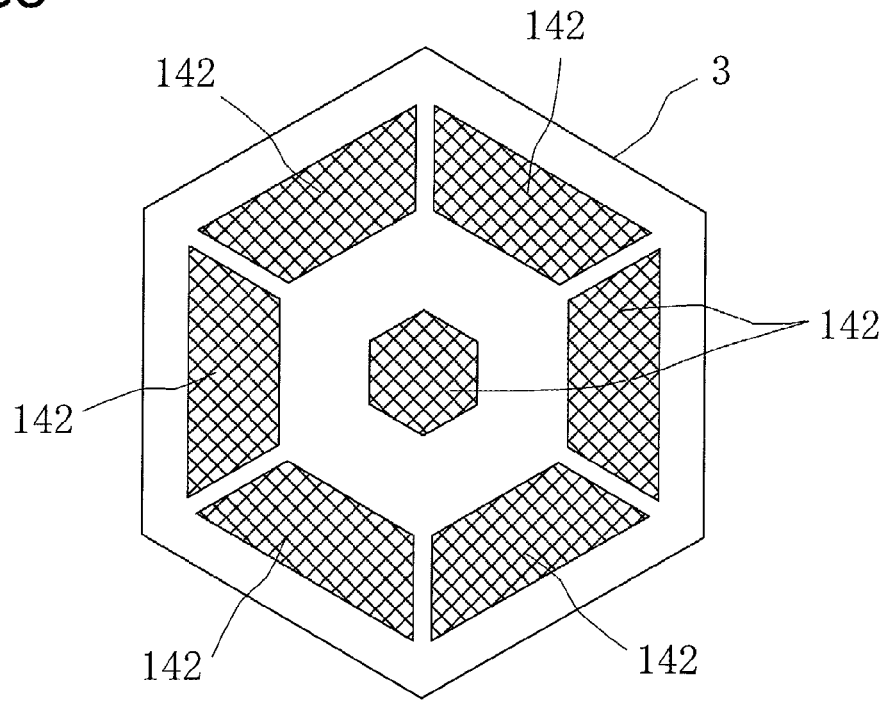
FIG. 33 is a plan view depicting the structure of step parts provided on a front surface of a skin body according to a twentieth embodiment.

FIG. 33 describes shaping of step parts provided to a skin body 3 according to a twentieth embodiment. On a front surface of the skin body 3 depicted in FIG. 33, a plurality of recessed parts 142 with lines for meshing are provided so as to configure a ripple shape, and thereby the recessed parts 142 are configured as a lower portion of the step parts. The plurality of recessed parts 141 configuring a large annular shape are divided in a circumferential direction of the recessed parts 141. Also, the shape of the inner polygonal recessed part 142 when viewed from a flat surface is not restricted to a polygonal shape, and may be a circle, an oval shape, or an arc shape. Furthermore, the shape of the outer annular recessed part 142 when viewed from a flat surface is not restricted to a polygonal shape, and may be a circle, an oval shape, or an arc shape. The plurality of recessed parts 141 and 142 may have a same depth or different depths.

Figure 34:
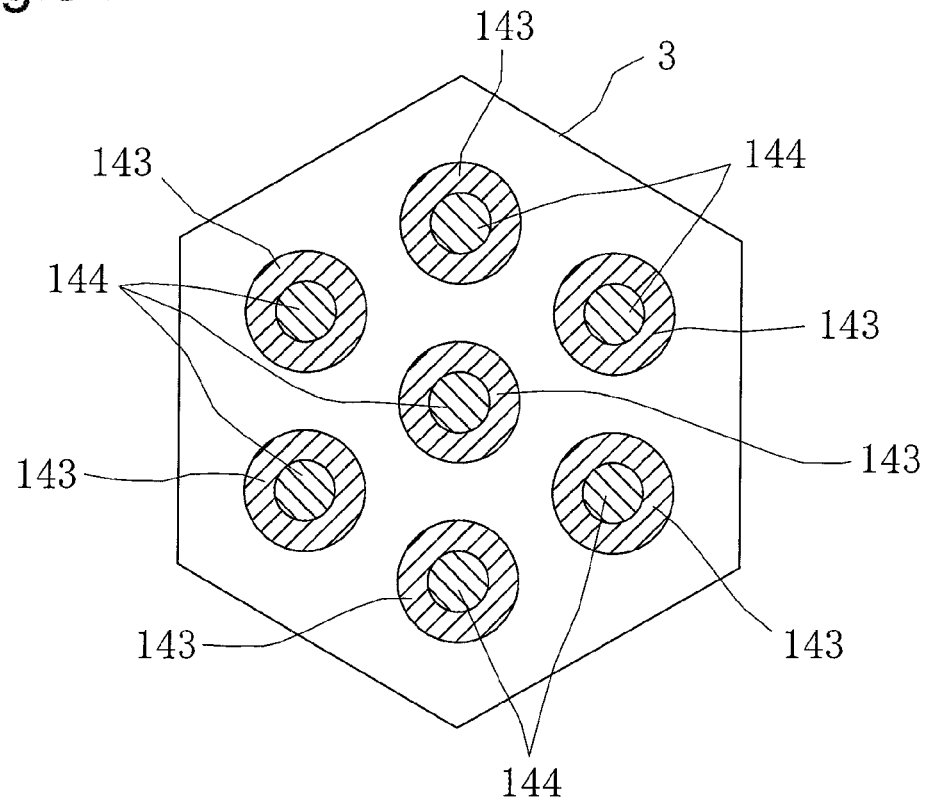
FIG. 34 is a plan view depicting the structure of step parts provided on a front surface of a skin body according to a twenty-first embodiment.

FIG. 34 describes shaping of step parts provided to a skin body 3 according to a twenty-first embodiment. On a front surface of the skin body 3 depicted in FIG. 34, a plurality of protruding parts 143 with diagonal lines are dispersedly provided. On an upper surface of each protruding parts 143, a protruding part 144 with diagonal lines is provided. With this, the protruding parts 143 and 144 and the front surface of the skin body 3 are configured as a lower portion of the step parts. Also, the shape of the protruding parts 143 and 144 when viewed from a flat surface is not restricted to a circle, and may be an oval shape, an arc shape, or a polygonal shape. The plurality of protruding parts 143 and 144 may have a same height or different heights. Furthermore, a structure is applicable in which a plurality of protruding parts 144 are provided in one protruding part 143 depicted in FIG. 34.

Figure 35:
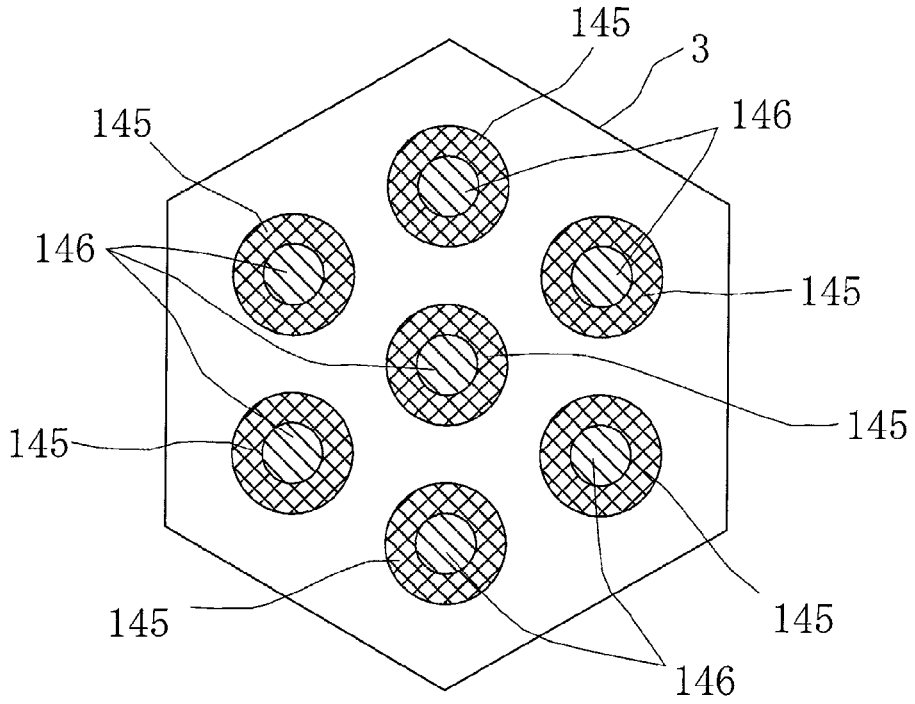
FIG. 35 is a plan view depicting the structure of step parts provided on a front surface of a skin body according to a twenty-second embodiment.

FIG. 35 describes shaping of step parts provided to a skin body 3 according to a twenty-second embodiment. On a front surface of the skin body 3 depicted in FIG. 35, a plurality of recessed parts 145 with lines for meshing are dispersedly provided. On a bottom surface of each recessed part 145, a protruding part 146 with diagonal lines is provided. With this, the recessed parts 14 is configured as a lower portion of the step parts. It is possible to apply a case in which an upper surface of the protruding part 146 protrudes upward more than a front surface of the skin body 3 and a case in which the upper surface does not protrude upward more than the front surface of the skin body 3. Also, the shape of the recessed part 145 and the protruding part 146 when viewed from a flat surface is not restricted to a circle, and may be an oval shape, an arc shape, or a polygonal shape. The plurality of recessed parts 145 may have a same depth or different depths, and the plurality of protruding parts 146 may have a same height or different heights. Furthermore, it is possible to apply a structure in which a plurality of protruding parts 146 are provided in one recessed part 145 depicted in FIG. 35.

Figure 36:
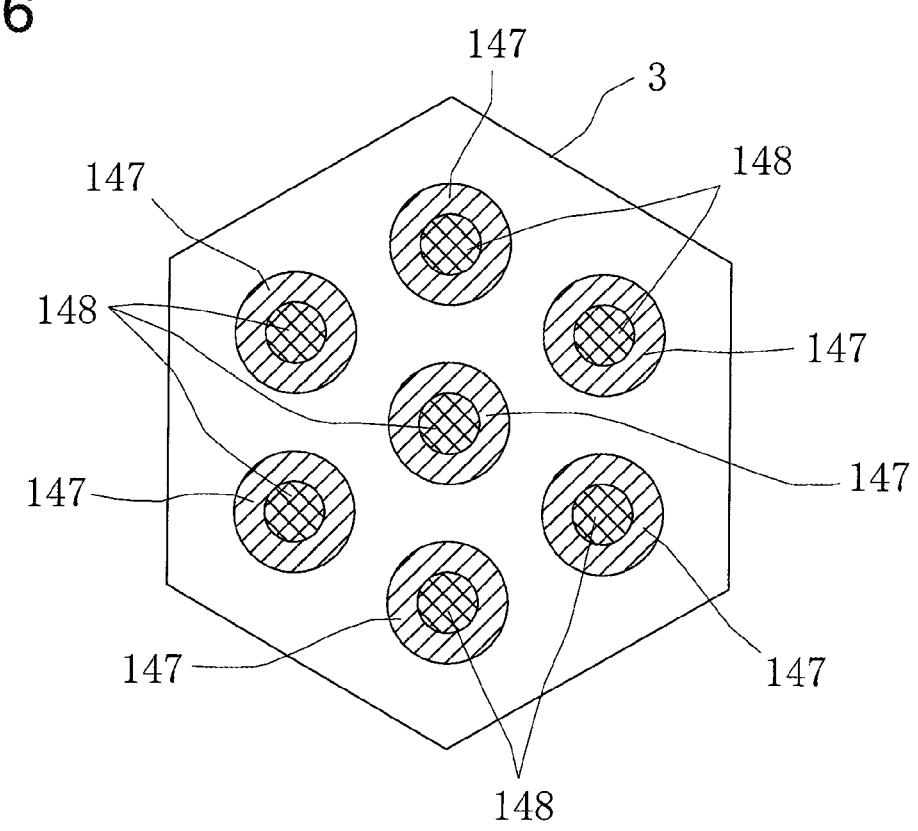
FIG. 36 is a plan view depicting the structure of step parts provided on a front surface of a skin body according to a twenty-third embodiment.

FIG. 36 describes shaping of step parts provided to a skin body 3 according to a twenty-third embodiment. On a front surface of the skin body 3 depicted in FIG. 36, a plurality of protruding parts 147 with diagonal lines are provided. On an upper surface of each protruding part 147, a recessed part 148 with lines for meshing is provided. With this, a front surface of the skin body 3 and the recessed parts 184 are configured as a lower portion of the step parts. Also, the shape of the protruding part 147 and the recessed part 148 when viewed from a flat surface is not restricted to a circle, and may be an oval shape, an arc shape, or a polygonal shape. The plurality of protruding parts 147 may have a same height or different heights, and the plurality of recessed parts 148 may have a same depth or different depths. Furthermore, it is possible to apply a structure in which a plurality of recessed parts 148 are provided in one protruding part 147 depicted in FIG. 36.

Figure 37:
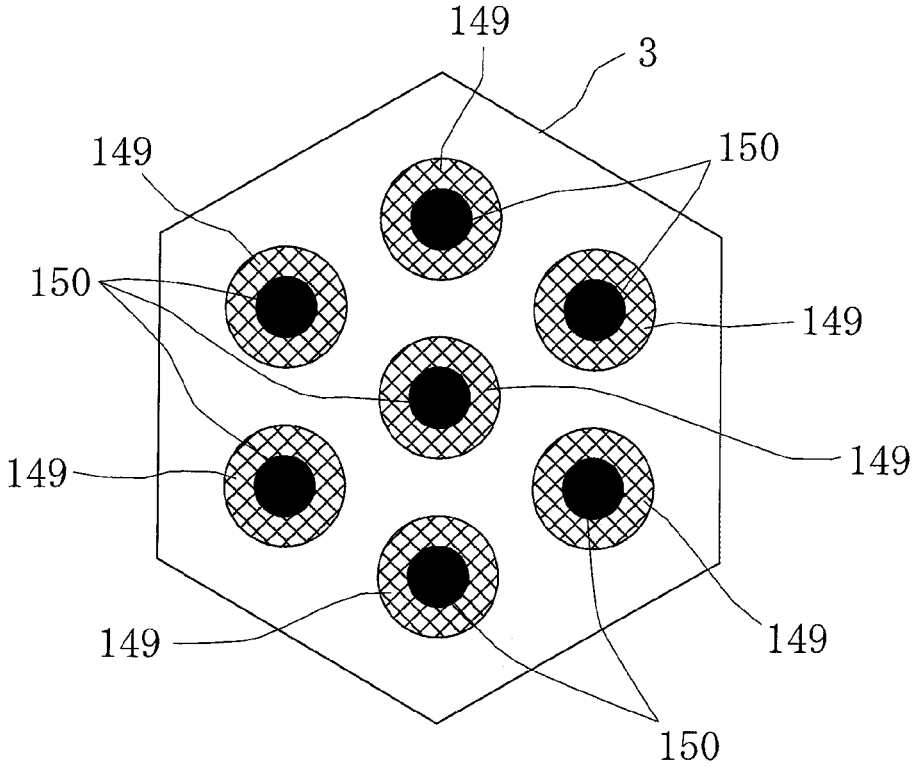
FIG. 37 is a plan view depicting the structure of step parts provided on a front surface of a skin body according to a twenty-fourth embodiment.
Figure 38:
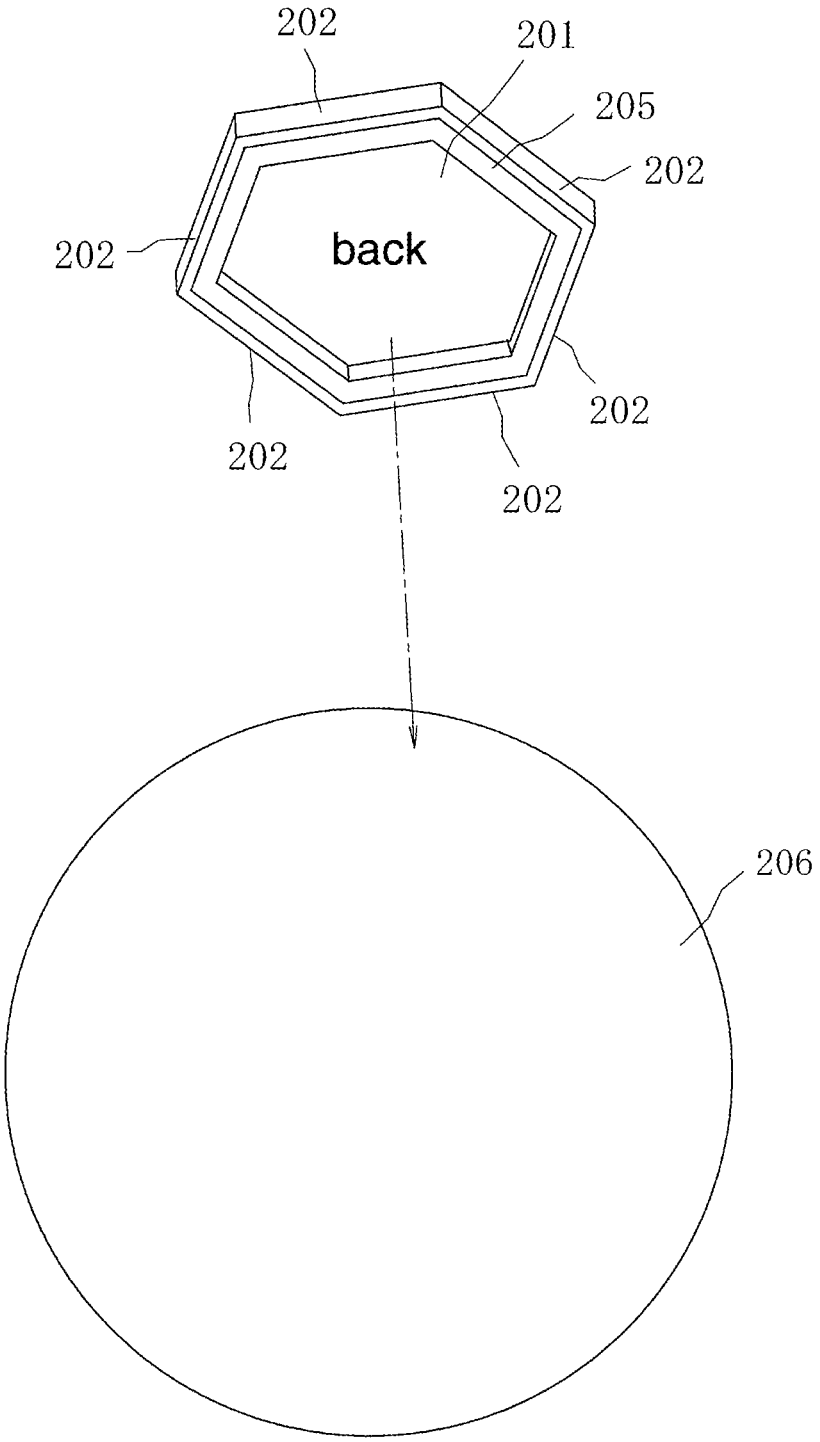
FIG. 38 is a perspective view depicting conventional ball main body and skin body as being exploded.

FIG. 37 describes shaping of step parts provided to a skin body 3 according to a twenty-fourth embodiment. On a front surface of the skin body 3 depicted in FIG. 37, a plurality of recessed parts 149 with lines for meshing are dispersedly provided. On a bottom surface of each recessed part 149, a recessed part 150 filled with black is provided. With this, the recessed parts 149 and 150 are configured as a lower portion of the step parts. Also, the shape of the recessed parts 149 and 150 when viewed from a flat surface is not restricted to a circle, and may be an oval shape, an arc shape, or a polygonal shape. The plurality of recessed parts 149 and 150 may have a same depth or different depths. Furthermore, it is possible to apply a structure in which a plurality of recessed parts 150 are provided in one recessed part 149 depicted in FIG. 37.

Other than the shaping of the step parts provided to the skin body 3 in the eleventh to twenty-fourth embodiments depicted in FIG. 24 to FIG. 37, although not depicted, the following shaping can be applied. For example, one large protruding part is provided on the front surface of the skin body 3, and one or two or more annular recessed parts are provided in the one protruding part. With this, on the front surface of the skin body 3, a ripple shape formed of the above protruding part and the above recessed parts is provided, and the front surface of the skin body 3 and the recessed parts are configured as a lower portion of the step parts. Alternatively, one recessed part is provided at a center portion on the front surface of the skin body 3, two or more recessed parts are radially provided around the one recessed part in an outer circumferential direction of the skin body 3, a recessed part is provided between these radially-provided recessed parts, and the depth of the radially-provided recessed parts and the depth of the recessed part therebetween are different from each other. With this, these recessed parts are configured as a lower portion of the step parts.

A relation between the material of the skin body 3 and injection molding, press molding, vacuum forming, or blow molding in each of the above embodiments is described. In injection molding and press molding, thermoplastic resin, thermosetting resin, or rubber can be used as a material of the skin body 3. In vacuum forming or blow molding, thermoplastic resin can be generally used as a material of the skin body 3. Also, when the plurality of skin bodies 3 are configured of thermoplastic resin of a same type, the circumferential wall parts 5 can be welded together.

Also, it is possible to apply the ball 1 depicted in FIG. 19 to FIG. 37 including the ball main body 2 without being provided with the skin body 3, where the front surface of the ball main body 2 is provided with a step part 129 where the finger 130 is hung depicted in FIG. 21, the step part 129 including the adhesion material 131 depicted in FIG. 22, or the step part depicted in FIG. 24 to FIG. 37.

The shape viewed from the flat surface of the skin body 3 according to each embodiment above is not restricted to a pentagon or a hexagon.

It is also possible to apply the plurality of skin bodies 3 according to each embodiment integrally configured so as to be in a mode of being coupled by molding of injecting a soft material made of resin or rubber into a mold, such as injection molding, press molding, vacuum forming, or blow molding.

REFERENCE SIGNS LIST

1 ball
2 ball main body
3 skin body
4 skin part
5 circumferential wall part
6 beveled part
7 cavity part
8 bulging part
9 bottom part
10 cavity part
11 aperture part
12 foam region part
21 mold
22 first mold

23 second mold
24 main-body outer wall surface part
25 beveled wall surface part
26 divisional surface part
27 main-body inner wall surface part
28 circumferential wall recessed part
29 divisional surface part
30 gate
31 straight line
32 molding space part
41 mold
42 first mold
43 second mold
44 main-body outer wall surface part
45 beveled wall surface part
46 circumferential-wall outer wall surface part
47 divisional surface part
48 main-body inner wall surface part
49 circumferential-wall inner wall surface part
50 divisional surface part
51 material
52 straight line
61 mold
62 first mold
63 second mold
64 main-body outer wall surface part
65 beveled wall surface part
66 divisional surface part
67 suction hole part
68 bottom surface part
69 circumferential-wall outer wall surface part
70 divisional surface part
71 suction hole part
72 upper clamp
73 lower clamp
74 spacer
75 material
76 material
81 mold
82 first mold
83 second mold
84 main-body outer wall surface part
85 beveled wall surface part
86 divisional surface part
87 bottom surface part
88 circumferential-wall outer wall surface part
89 divisional surface part
90 air blowing mechanism
91 nozzle
92 parison
101 mold
102 first mold
103 second mold
104 slide core
105 main-body outer wall surface part
106 beveled wall surface part
107 circumferential-wall outer wall surface part
108 divisional surface part
109 core accommodating part
110 divisional surface part
111 gate
112 molding space part
113 material
114 arrow
115 ball main body
121 flat surface part
122 tilted surface part
123 large recessed part (step part)
124 small recessed part
125 center part of the ball 1
126 radius of a virtual circle centering at the center part 125
127 radius of a front surface of the ball main body 2 centering at the center part 125
128 step part
129 step part
130 finger
131 adhesion material
132 cushion part
133 protruding part
134 protruding part
135 protruding part
136 recessed part
137 protruding part
138 recessed part
139 recessed part
140 recessed part
141 recessed part
142 recessed part
143 protruding part
144 protruding part
145 recessed part
146 protruding part
147 protruding part
148 recessed part
149 recessed part
150 recessed part
151 protruding part
152 recessed part
153 protruding part
154 recessed part
155 protruding part
156 recessed part
157 recessed part
158 recessed part
201 skin body
202 folding part
203 notch part
204 folding part
205 support member
206 ball main body
207 cavity part

The invention claimed is:

1. A ball including:

a ball main body covered with a plurality of skin bodies;

each skin body is one-piece of homogenous material and integrally formed of a soft material made of resin or rubber so as to have a shape having a skin part, a circumferential wall part and a cavity part;

the skin part facing a surface of the ball main body;

the circumferential wall part protruding from a peripheral edge part of the skin part toward the ball main body, wherein the circumferential wall part is formed into its shape by injection molding;

the cavity part formed of a back surface of the skin part that faces toward the surface of the ball main body, the circumferential wall part, and at least one of the ball main body or a bottom part included in the skin body, the cavity part being disposed between the skin part and the ball main body;

a cushion part is present in the cavity part; and the cushion part includes a distribution of air and the entire cushion part is configured to have substantially consistent compressibility due to a uniform distribution of the cushion part throughout the cavity part and due to the distribution of air, wherein at least a portion of the cushion part directly contacts the corresponding skin body, the skin body and the cushion part having been formed by a process of injecting soft material including a foaming agent while in a fluid form into a mold including a slide core to form the skin body, and moving the slide core away from the skin part of the skin body such that the foaming agent effervesces and the cushion part is formed from the foaming agent inside the cavity part, wherein portion of the skin part is separated from the surface of the ball main body by the cushion part in the cavity part.

2. The ball according to claim 1, wherein a beveled part configured by removal so that a dihedral angle between the skin part and the circumferential wall part forms a flat surface or curved surface is provided on a front side of the skin body.

3. The ball according to claim 1, wherein non-slippery asperities or a coating film made of a non-slippery material is formed on a front surface of the skin part.

4. A ball including:

a ball main body covered with a plurality of skin bodies;

each skin body is one-piece of homogenous material and integrally formed of a soft material made of resin or rubber so as to have a shape having a skin part, a circumferential wall part and a cavity part;

the skin part facing a surface of the ball main body;

the circumferential wall part protruding from a peripheral edge part of the skin part toward the ball main body, wherein the circumferential wall part is formed into its shape by injection molding;

the cavity part formed of a back surface of the skin part that faces toward the surface of the ball main body, the circumferential wall part, and at least one of the ball main body or a bottom part included in the skin body, the cavity part being disposed between the skin part and the ball main body;

at least one of a cushion part or air is present in the cavity part; and the cushion part includes a distribution of air and the entire cushion part is configured to have substantially consistent compressibility due to a uniform distribution of the cushion part throughout the cavity part and due to the distribution of air, wherein at least a portion of the cushion part directly contacts the corresponding skin body, wherein a central portion of the skin part is separated from the surface of the ball main body by the cushion part in the cavity part or the air in the cavity part, and wherein a bulging part configured to extend from the circumferential wall part to a center part side and be separated from the skin part is provided on a back side of the skin body.

5. The ball according to claim 1, wherein the bottom part is formed over the circumferential wall part, and the cavity part is formed by the back surface of the skin part, the circumferential wall part, and the bottom part.

6. A ball comprising:

a plurality of skin bodies that include a corresponding front surface that faces radially outward from a center of the ball, wherein at least one pair of front surfaces of adjacent skin bodies of the plurality of skin bodies together form a step part, in a radial direction extending from a center of the ball, where the front surfaces adjoin, wherein the step part only partially circumscribes a center of each corresponding front surface of the at least one pair of front surfaces, and wherein multiple other skin bodies abut each of the adjacent skin bodies;

wherein a radially outermost portion of one of the front surfaces of the pair of front surfaces is radially outward of a radially outermost portion of the other front surface of the pair of front surfaces; and wherein the plurality of skin bodies contact an outer face of a ball main body of the ball and are located adjacent to the ball main body in a circumferential direction.

7. The ball according to claim 1, further including:

a step part where a finger is hung provided on an outermost surface of the ball;

wherein an adhesion material at least partially forms a portion of the outermost surface and the step part.

8. The ball according to claim 7, wherein the step part is configured of a recessed part.

9. A ball including:

a ball main body covered with a plurality of skin bodies;

one of the plurality of skin bodies including a skin part that forms part of an outermost surface of the ball and including a planar surface part and a tilted surface part that circumscribes the planar surface part, wherein the planar surface part is radially inward, with respect to a center of the ball, of a radially outermost portion of the outermost surface;

wherein the one of the plurality of skin bodies includes a circumferential wall part protruding from a peripheral edge part of the skin part toward the ball main body, wherein each side of the circumferential wall part is abutted by a side of a corresponding adjacent skin body of the plurality of skin bodies, and wherein substantially an entire circumferential length of the circumferential wall part is abutted by the corresponding adjacent skin bodies;

wherein the tilted surface part is flat in cross-section and extends circumferentially, the tilted surface part and the planar surface part together form a convex shape such that the tilted surface part faces away from an axis that extends orthogonally through the planar surface part, and the planar surface part abuts the tilted surface part.

10. The ball according to claim 1, wherein the skin part is flat-plate shaped.

11. The ball according to claim 1, wherein the cavity part is formed by the back surface of the skin part, the circumferential wall part, and the ball main body.

12. The ball according to claim 1, wherein the cushion part includes foam.

13. The ball according to claim 12, wherein the cushion part includes foamed resin.

14. The ball according to claim 7, wherein the step part is provided on a front surface of a ball main body of the ball without a skin body provided thereto or on a front surface of the skin body.

15. The ball according to claim 9, wherein the planar surface part is at least partially formed by a center part of a skin body.

16. The ball according to claim 9, wherein the planar surface part and the tilted part are provided on a front surface of a ball main body without a skin body provided thereto or on a front surface of the skin body covering the ball main body.

17. A method of manufacturing the ball according to claim 1, the method including:

injecting the soft material including a foaming agent while in a fluid form into a mold including a slide core to form at least one of the plurality of skin bodies, wherein mold forms the circumferential wall part protruding from the peripheral edge part of the skin part to at least partially define the cavity part; and moving the slide core away from the respective skin part of the at least one of the plurality of skin bodies such that the foaming agent effervesces and the cushion part is formed from the foaming agent inside the cavity part.

18. The ball according to claim 1, wherein the cavity part is disposed between the skin part and the ball main body when the ball main body is in its usable state.

19. The ball according to claim 1, wherein the entire cavity is filled with the cushion part.

* * * * *